US005736285A

United States Patent [19]

Nukada et al.

[11] Patent Number: 5,736,285

[45] Date of Patent: Apr. 7, 1998

[54] ELECTROPHOTOGRAPHIC PHOTOSENSITIVE MEMBER

[75] Inventors: Katsumi Nukada; Masahiro Iwasaki; Toru Ishii, all of Minami-ashigara, Japan

[73] Assignee: Fuji Xerox Co., Ltd., Tokyo, Japan

[21] Appl. No.: 708,416

[22] Filed: Sep. 5, 1996

Related U.S. Application Data

[63] Continuation-in-part of Ser. No. 461,432, Jun. 5, 1995, Pat. No. 5,604,064.

[30] Foreign Application Priority Data

Sep. 11, 1995 [JP] Japan ..... 7-232761

[51] Int. Cl.[6] ..... G03G 5/06

[52] U.S. Cl. ..... 430/83; 430/96

[58] Field of Search ..... 430/59, 78, 96, 430/83

[56] References Cited

U.S. PATENT DOCUMENTS

| | | | |
|---|---|---|---|
| 4,801,517 | 1/1989 | Frechet et al. | 430/59 |
| 4,806,443 | 2/1989 | Yanus et al. | 430/56 |
| 4,806,444 | 2/1989 | Yanus et al. | 430/56 |
| 4,937,165 | 6/1990 | Ong et al. | 430/59 |
| 4,959,288 | 9/1990 | Ong et al. | 430/59 |
| 4,983,482 | 1/1991 | Ong et al. | 430/59 |
| 5,034,296 | 7/1991 | Ong et al. | 430/59 |
| 5,589,309 | 12/1996 | Suzuki et al. | 430/59 |
| 5,604,064 | 2/1997 | Nokada et al. | 430/59 |

FOREIGN PATENT DOCUMENTS

| | | |
|---|---|---|
| B2-59-28903 | 7/1984 | Japan . |
| A-61-20953 | 1/1986 | Japan . |
| A-1-134456 | 5/1989 | Japan . |
| A-1-134457 | 5/1989 | Japan . |
| A-1-134462 | 5/1989 | Japan . |
| A-4-133065 | 5/1992 | Japan . |
| A-4-133066 | 5/1992 | Japan . |

*Primary Examiner*—John Goodrow
*Attorney, Agent, or Firm*—Oliff & Berridge, PLC

[57] ABSTRACT

An electrophotographic photosensitive member including a photosensitive layer on a conductive substrate thereof. The photosensitive layer contains a charge transport polyester resin containing at least one of structures represented by the following general formulas (I-1) and (I-2) as a partial structure of repeated units; and at least one bisazo pigment represented by the following general formula (A) or condensational and polycyclic aromatic pigment:

(I-1)

(I-2)

where $R_1$ to $R_4$ are each independently, a hydrogen atom or the like, X is a bivalent aryl group, k and I are 0 or 1 and T is a hydrocarbon radical, $$Cp\text{-}N{=}N\text{-}G\text{-}N{=}N\text{-}Cp' \quad (A)$$

wherein Cp and Cp' are each a coupler and G is a predetermined bivalent group.

20 Claims, 3 Drawing Sheets

ELECTROPHOTOGRAPHIC PHOTOSENSITIVE MEMBER

CROSS REFERENCE TO RELATED APPLICATION

This application is a Continuation-In-Part of application Ser. No. 08/461,432, filed Jun. 5, 1995, now U.S. Pat. No. 5,604,064.

BACKGROUND OF THE INVENTION

1. Field of the Invention

The present invention relates to an electrophotographic photosensitive member exhibiting excellent wear resistance, electric stability and so forth.

2. Description of Related Art

In recent years, a variety of materials having excellent properties have been developed as organic photosensitive members. However, the photosensitivity of the organic photosensitive members each containing such a material has not exceeded that of conventional inorganic photosensitive members such as Se alloy. Although high-speed copying machines and printers of a type using the organic photosensitive member have been placed on the market, the present performance of the organic photosensitive member is unsatisfactory when the organic photosensitive member is used in the high-speed copying machine and the printer. Thus, elongation of the life of the organic photosensitive member and improvement in electric stability of the same have been required. The organic photosensitive member is used such that an electric charge is given to the surface of a substantially insulating photosensitive layer in a dark state; and the electric charge is quickly removed when the surface is illuminated, whereby an electrostatic image is formed. Therefore, its charge potential and photosensitivity greatly depend upon the thickness of the photosensitive layer. Thus, an important factor for determining the life of the organic photosensitive member is wear of the surface of the photosensitive layer. In particular, a charge generating material having excellent sensitivity in a visible region exhibits an excellent high sensitivity characteristic such that the efficiency in generating a charge due to light is always satisfactory regardless of the level of an electric field (a value obtained by dividing the potential of the surface of the photosensitive member by the thickness of the photosensitive layer). On the other hand, the charge generating efficiency of a charge generating material, represented by phthalocyanine pigment and having sensitivity in the near-infrared region, has a tendency such that the efficiency is raised in proportion to the rise of the level of the electric field (the efficiency deteriorates when the level of the electric field is lowered). However, the excellent high sensitivity characteristic, such that the charge generating efficiency is not changed by the electric field, raises a problem in the condition where the photosensitive member is used for a long time and the thickness of the photosensitive layer cannot be ignored.

That is, when the actual thickness of the photosensitive layer has been reduced from L0 to L1, the substantial charge reservation amount of the photosensitive member is increased to L0/L1 times. After the photosensitive member has been illuminated with the same quantity of light, the same surface potential can be obtained by enlarging the quantity of generated charge to L0/L1 times. If the charge generating efficiency of the charge generating material is in proportion to the electric field in the photosensitive layer, the electric field is enlarged to L0/L1 times because of reduction in the thickness and also the amount of the generated charge is enlarged to L0/L1 times so that the foregoing condition is satisfied even if the quantity of applied light is constant. However, if the charge generating efficiency is constant regardless of the electric field in the photosensitive layer, the quantity off light to be applied must be enlarged to be L0/L1 times in order to make the amount of the charge generated because of irradiation with light to be L0/L1 times. Thus, a mechanism is required which is capable of changing the quantity off light in accordance with the reduction in the thickness of the photosensitive layer, in a case where a photosensitive member for visible light, which has excellently high sensitivity characteristic, is intended to be used in a copying machine or the like for a long time. Thus, the complicated structure of the machine deteriorates the reliability and excessively raises the cost.

Therefore, prevention of the reduction in the thickness of the charge transport layer, which is the surface layer, is a very important technical issue to be required in order to cause the charge generating material for visible light to, for a long time, exhibit its excellent characteristic that its charge generating efficiency is satisfactory regardless of the level of the electric field. Prevention of the deterioration in the actual sensitivity of the photosensitive member due to the reduction in the thickness is required, particularly in order to realize a printer used for a long time equivalent to or longer than the conventional printer, and comprising a visible-ray type semiconductor laser unit, which is capable of relatively easily realizing a higher resolution in place of a laser printer formed by combing a semiconductor laser unit for emitting a near-infrared beam and a charge generating material having the charge generating efficiency relatively depending upon the electric field.

Since the majority of the organic photosensitive members available at present have a so-called laminated type structure formed by laminating a charge transport layer on a charge generating layer, the charge transport layer is usually formed as the surface layer. A low molecular weight charge transport material dispersed type charge transport layer, which is popular at present, has given satisfactory electric characteristics. However, the structure for use such that low molecular weight substances are dispersed in a binder resin results in deterioration of the original mechanical performance of the binder resin. Thus, there arises a problem in that the low molecular charge transport material dispersed type charge transport layer is too weak against abrasion.

On the contrary, since a charge transport polymer has a possibility capable of solving the foregoing problem, it has energetically been developed and researched. For example, polycarbonate prepared by polymerizing specific dihydroxyarylamine and bischloroformate is disclosed in U.S. Pat. No. 4,806,443, and polycarbonate prepared by polymerizing specific dihydroxyarylamine and phosgene is in U.S. Pat. No. 4,806,444. Polycarbonate prepared by polymerizing bishydroxyarylamine and bischloroformate or phosgene is disclosed in U.S. Pat. No. 4,801,517. In U.S. Pat. No. 4,937,165 and U.S. Pat. No. 4,959,288, polycarbonate prepared by polymerizing specific dihydroxyarylamide or bishydroxyarylamine and bischloroformate or polyester prepared by polymerizing the same and bisacylhalide is disclosed. In U.S. Pat. No. 5,054,296, polycarbonate or polyester of arylamine having a specific fluorene skeleton is disclosed. In U.S. Pat. No. 4,983,482, polyurethane is disclosed. In JP-B-59-28903, polyester, the main chain of which is specific bisstyryl bisarylamine, is disclosed (a photo electroconductive member wherein an eutectic complex of i) polyester having an arylamine skelton of a specific structure and ii) a colorant of pyrylium salt is used.). In JP-A-61-20953, JP-A-1-134456, JP-A-1-134457, JP-A-1-134462, JP-A-4-133065 and JP-A-4-133066, polymers, the pendant of which is a charge transport type substituent, such as hydrazone or triarylamine and photosensitive members using the polymers are disclosed.

Although use of the foregoing material results in improving resistance against abrasion, unsatisfactory charge transport performance causes the stability of the electric characteristics to deteriorate. Thus, elongation of the life off the organic photosensitive member cannot satisfactorily be achieved. Also the sensitivity is required to be further improved.

SUMMARY OF THE INVENTION

An object off the present invention is to provide an electrophotographic photosensitive member having excellent wear resistance and stable electric-characteristics and exhibiting a long life.

Another object of the present invention is to provide an electrophotographic photosensitive member also exhibiting excellent sensitivity.

In order to improve the characteristics of the photosensitive member, the inventors have developed a new charge transport polymer having excellent performance (U.S. applications Ser. No. 08/409,517 now abandoned, Ser. No. 08/461,432, now U.S. Pat. No. 5,604,064 and Ser. No. 08/542,831) pending, and further have attempted many investigations. As one of the investigations above, the performance of the electrophotographic photosensitive member has been examined while the combination is changed of the charge transport polymer having the excellent performance and a variety of charge generating materials. As a result, the inventors have found a fact that a combination of the polymer with specific pigment serving as the charge generating material enables a photosensitive member having excellent sensitivity and electrical stability and long life to be obtained, so as to accomplish the present invention which is capable of achieving the foregoing objects.

That is, according to one aspect of the present invention, there is provided an electrophotographic photosensitive member comprising: a photosensitive layer on a conductive substrate thereof, wherein the photosensitive layer contains a charge transport polyester resin containing at least one of structures represented by the following general formulas (I-1) and (I-2) as a partial structure of repeated units; and at least one bisazo pigment represented by the following general formula (A):

(I-1)

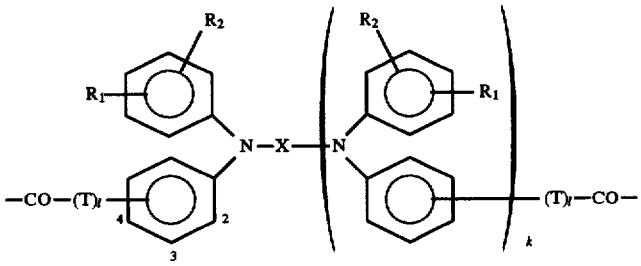

(I-2)

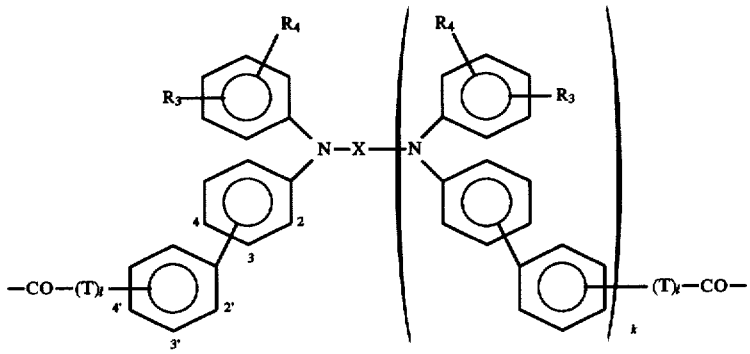

wherein $R_1$ to $R_4$ are each independently, a hydrogen atom, an alkyl group, an alkoxy group, a substituted amino group, halogen or a substituted or a non-substituted aryl group, X is a substituted or a non-substituted bivalent aromatic group, k and l are each an integer selected from the group consisting off 0 and 1 and T is a hydrocarbon radical having 1 to 10 carbon atoms and permitted to be branched, $$Cp\text{-}N{=}N\text{-}G\text{-}N{=}N\text{-}Cp' \quad (A)$$

wherein Cp and Cp' are each a coupler having aromatic characteristics, Cp and Cp' may be the same or different from each other and G is a bivalent group in which each of carbon atoms, to which the azo group is bonded, is a $sp^2$-type carbon atom, which forms a double bond.

According to a second aspect of the present invention, there is provided an electrophotographic photosensitive member comprising: a photosensitive layer on a conductive substrate thereof, wherein the photosensitive layer contains a charge transport polyester resin containing at least one of structures represented by the foregoing general formulas (I-1) and (I-2) as a partial structure of repeated units; and at least one condensational and polycyclic aromatic pigment.

Although the reason why the excellent effects of the present invention can be achieved because of the combination of the charge transport polymer having the high performance and the specific pigment, it can be considered that the affinity between the two substances and the mutual electrical effect cause the two substances to exhibit a synergistic effect.

Bisazo pigment has been known as a charge generating material having high performance. A fact has been reported that the charge generating effficiency can be intensified when the bisazo pigment and the charge transport material are brought into contact with each other in. For example, 10 (1991) of 3-rd Study Meeting of Electronic Photography Society held in 1991. However, no report has been made about any specific molecular design of the charge transport material which enables a significantly advantageous effect to be obtained when combined with the bisazo pigment. Moreover, substantially no attempt has been known in which the sensitivity, the wear resistance and electric stability are intended to be improved by combining the bisazo pigment with the charge transport polymer. Also the condensational and polycyclic aromatic pigment has been known as a charge generating material having high performance as well as the bisazo pigment. As a result of the investigation about the charge generating mechanism performed by the inventors of the present invention, a fact has been found that the sensitivity can be improved because of a mechanism similar to that of the bisazo pigment. Also, to this pigment combined with a charge transport material, the above-mentioned matters are similarly applied.

Thus, it is noteworthy that the structure of the present invention enables a significantly advantageous effect to be obtained.

DESCRIPTION OF THE PREFERRED EMBODIMENTS

Figure 1:
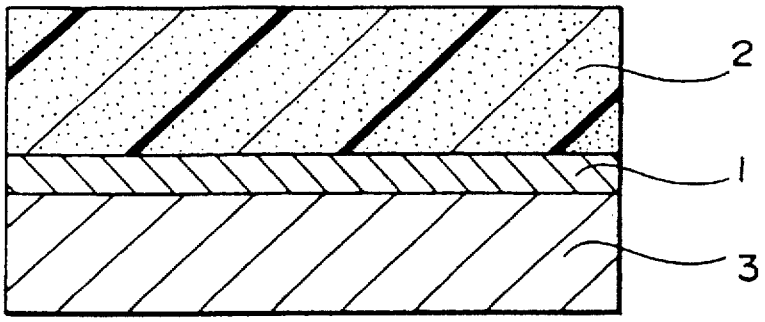
FIG. 1 is a schematic cross sectional view showing an example of the structure of an electrophotographic photosensitive member according to the present invention.

The present invention will now be described in detail.

Pigment for use in the present invention as a charge generating material will firstly be described.

A variety of bisazo pigment materials have been suggested which have been prepared by combining azo components and coupler components. Moreover, there have been disclosed asymmetrical bisazo pigment having a structure such that its right coupler and its left coupler are different from each other and use of mixture of symmetrical bisazo pigment and asymmetrical bisazo pigment.

In the present invention, bisazo pigment represented by general formula (A) is employed. In particular, when the bisazo pigment wherein G is any one of (a) to (f) is combined with a charge transport polymer according to the present invention, in particular, when the same is combined with a charge transport polyester represented by any one of general formulas (II) to (IV), a photosensitive member can be obtained which exhibits excellent sensitivity and satisfactory stability, which is free from change in the potential when the thickness of the charge transport layer has been reduced and which has a long life.

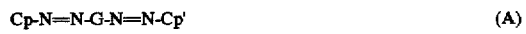

Cp-N=N-G-N=N-Cp' (A)

wherein Cp and Cp' are each a coupler having aromatic characteristics, Cp and Cp' may be the same or different from each other and G is a bivalent group in which each of carbon atoms, to which the azo group is bonded, is a $sp^2$-type carbon atom, which forms a double bond.

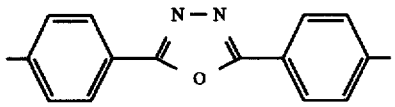

(a)

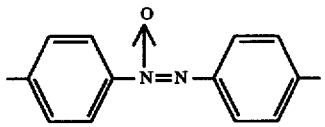

(b)

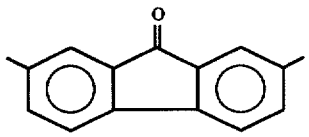

(c)

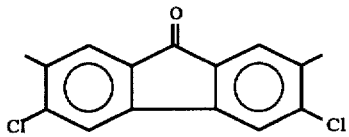

(d)

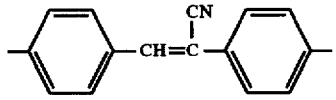

(e)

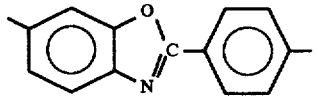

(f)

Specific examples of the couplers are shown in Tables 1 and 6, while specific examples of the azo pigment are shown in Tables 7 to 9. In the present invention, however, they are not limited to these examples. As can be understood from the tables, representative examples of the coupler include a coupler containing a naphthalene ring structure and a coupler containing an anthracene ring structure, in particular, such couplers having a hydroxyl group. The coupler containing a naphthalene ring structure is a coupler having a naphthalene ring bonded to or incorporated in any portion of the constitutional formula. The expression similar to the above hereinafter has a similar meaning.

TABLE 1
Specific Examples of Couplers Cp and Cp'
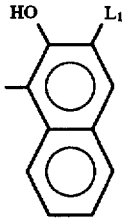
| COUPLER NO. | STRUCTURE OF $L_1$ |
|---|---|
| Cp-1 | 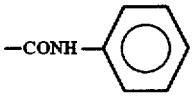  |
| Cp-2 | 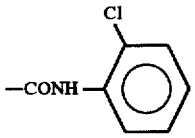  |
| Cp-3 | 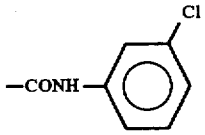  |
| Cp-4 | 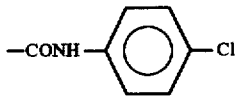  |
| Cp-5 | 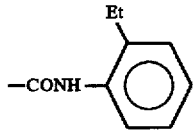  |
| Cp-6 | 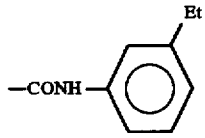  |
| Cp-7 | 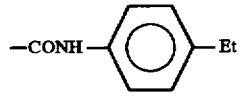  |
| Cp-8 | 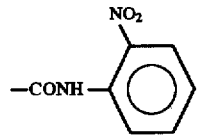  |
| Cp-9 | 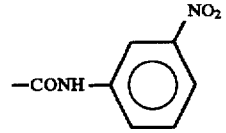  |
TABLE 1-continued
Specific Examples of Couplers Cp and Cp'
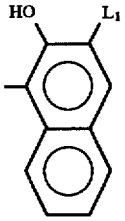
| COUPLER NO. | STRUCTURE OF $L_1$ |
|---|---|
| Cp-10 | 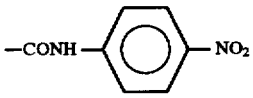  |
| Cp-11 | 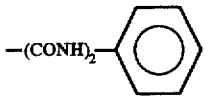  |
| Cp-12 | 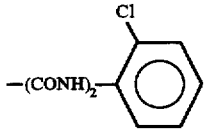  |
| Cp-13 | 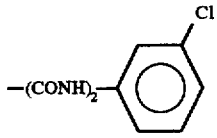  |
| Cp-14 | 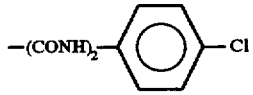  |
| Cp-15 | 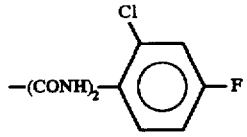  |
| Cp-16 | 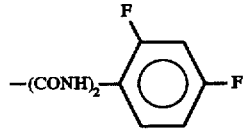  |
| Cp-17 | 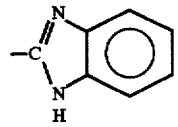  |
| Cp-18 | 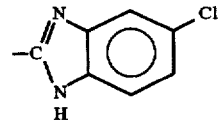  |

TABLE 1-continued
Specific Examples of Couplers Cp and Cp'
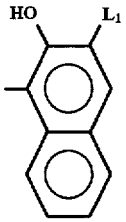
| COUPLER NO. | STRUCTURE OF $L_1$ |
|---|---|
| Cp-19 | 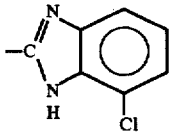 |
| Cp-20 | 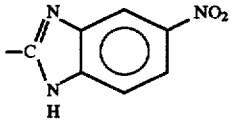 |
| Cp-21 | 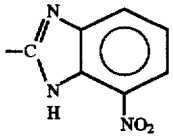 |
TABLE 2
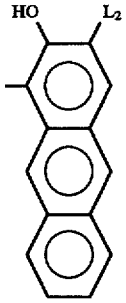
| COUPLER NO. | STRUCTURE OF $L_2$ |
|---|---|
| Cp-22 | 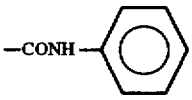 |
| Cp-23 | 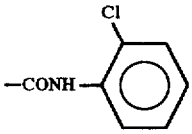 |
| Cp-24 | 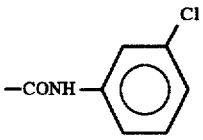 |
TABLE 2-continued
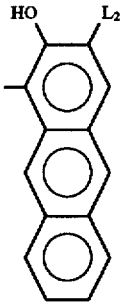
| COUPLER NO. | STRUCTURE OF $L_2$ |
|---|---|
| Cp-25 | 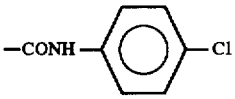 |
| Cp-26 | 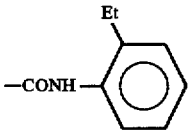 |
| Cp-27 | 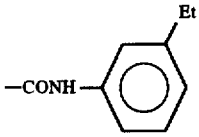 |
| Cp-28 | 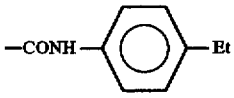 |
| Cp-29 | 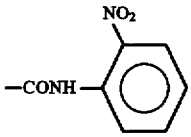 |
| Cp-30 | 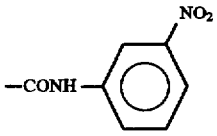 |
| Cp-31 | 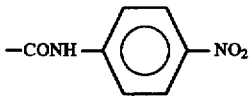 |
| Cp-32 | 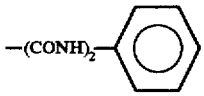 |
| Cp-33 | 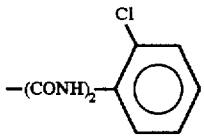 |

TABLE 2-continued
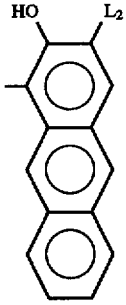
| COUPLER NO. | STRUCTURE OF $L_2$ |
|---|---|
| Cp-34 | 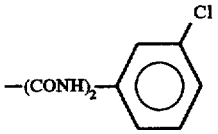 |
| Cp-35 | 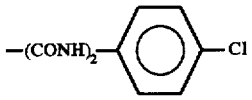 |
| Cp-36 | 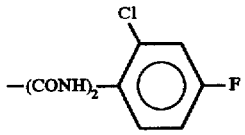 |
| Cp-37 | 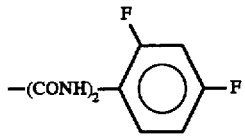 |
| Cp-38 | 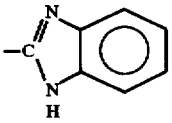 |
| Cp-39 | 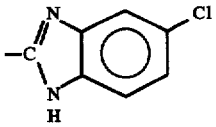 |
| Cp-40 | 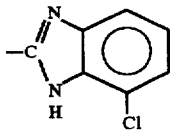 |
| Cp-41 | 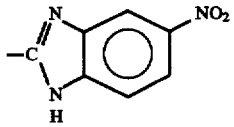 |
| Cp-42 | 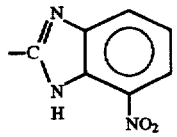 |
TABLE 3
Specific Examples of Couplers Cp and Cp'
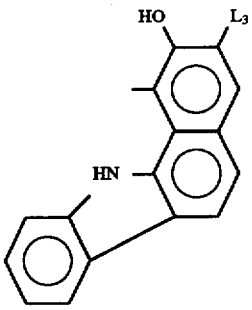
| COUPLER NO. | STRUCTURE OF $L_3$ |
|---|---|
| Cp-43 | 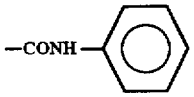 |
| Cp-44 | 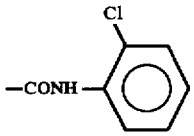 |
| Cp-45 | 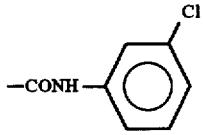 |
| Cp-46 | 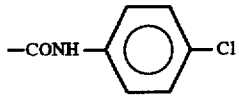 |
| Cp-47 | 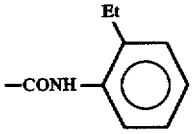 |
| Cp-48 | 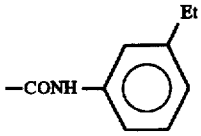 |
| Cp-49 | 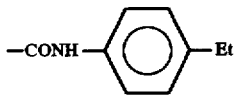 |
| Cp-50 | 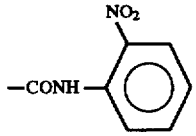 |
| Cp-51 | 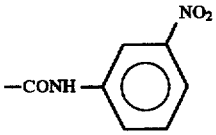 |

TABLE 3-continued
Specific Examples of Couplers Cp and Cp'
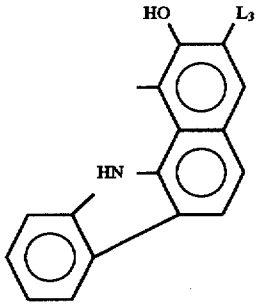
| COUPLER NO. | STRUCTURE OF $L_3$ |
|---|---|
| Cp-52 | 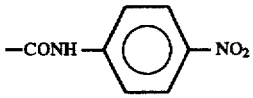 |
| Cp-53 | 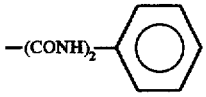 |
| Cp-54 | 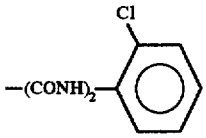 |
| Cp-55 | 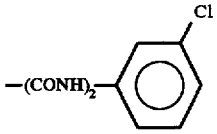 |
| Cp-56 | 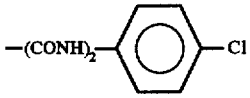 |
| Cp-57 | 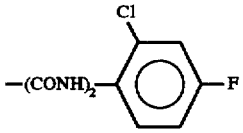 |
| Cp-58 | 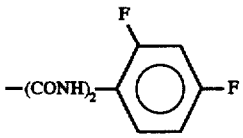 |
| Cp-59 | 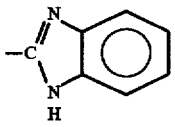 |
| Cp-60 | 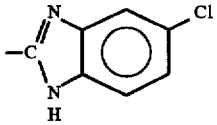 |
TABLE 3-continued
Specific Examples of Couplers Cp and Cp'
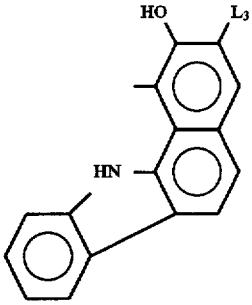
| COUPLER NO. | STRUCTURE OF $L_3$ |
|---|---|
| Cp-61 | 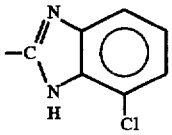 |
| Cp-62 | 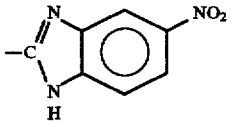 |
| Cp-63 | 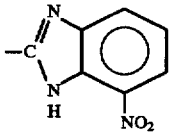 |
TABLE 4
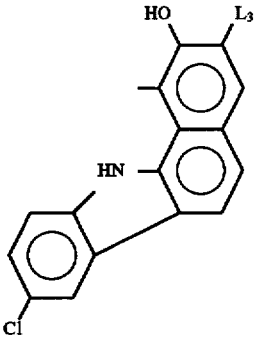
| COUPLER NO. | STRUCTURE OF $L_4$ |
|---|---|
| Cp-64 | 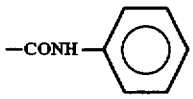 |
| Cp-65 | 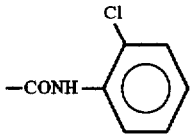 |

TABLE 4-continued
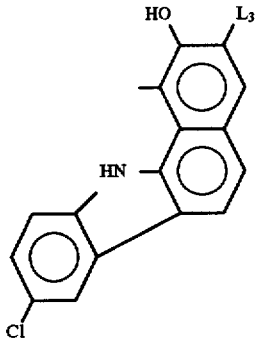
| COUPLER NO. | STRUCTURE OF $L_4$ |
|---|---|
| Cp-66 | 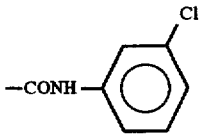  |
| Cp-67 | 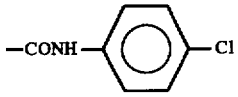  |
| Cp-68 | 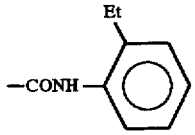  |
| Cp-69 | 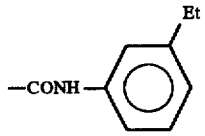  |
| Cp-70 | 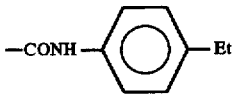  |
| Cp-71 | 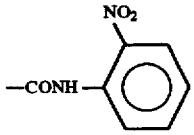  |
| Cp-72 | 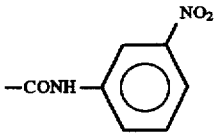  |
| Cp-73 | 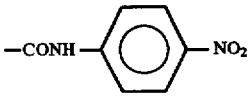  |
| Cp-74 | 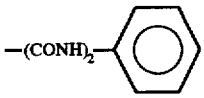  |
TABLE 4-continued
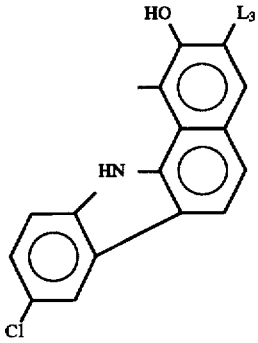
| COUPLER NO. | STRUCTURE OF $L_4$ |
|---|---|
| Cp-75 | 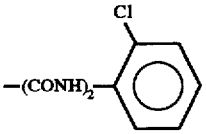  |
| Cp-76 | 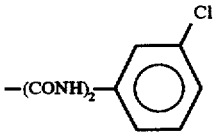  |
| Cp-77 | 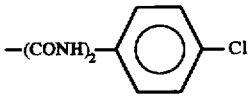  |
| Cp-78 | 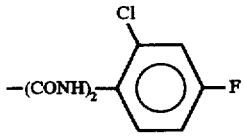  |
| Cp-79 | 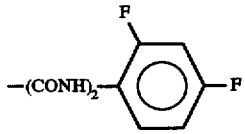  |
| Cp-80 | 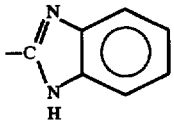  |
| Cp-81 | 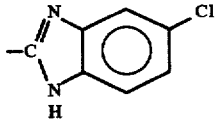  |
| Cp-82 | 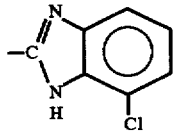  |
| Cp-83 | 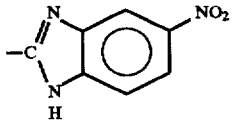  |

TABLE 4-continued
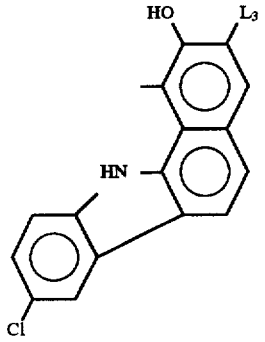
| COUPLER NO. | STRUCTURE OF $L_4$ |
|---|---|
| Cp-84 | 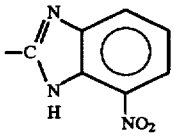 |
TABLE 5
Specific Examples of Couplers Cp and Cp'
| COUPLER NO. | STRUCTURE |
|---|---|
| Cp-85 | 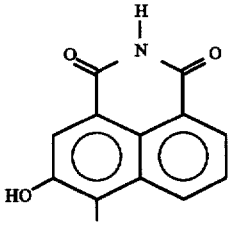 |
| Cp-86 | 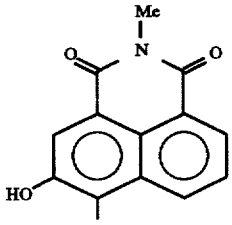 |
| Cp-87 | 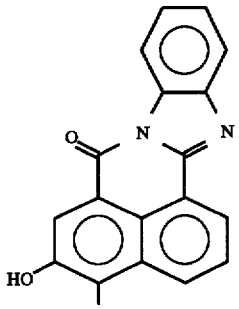 |
TABLE 5-continued
Specific Examples of Couplers Cp and Cp'
| COUPLER NO. | STRUCTURE |
|---|---|
| Cp-88 | 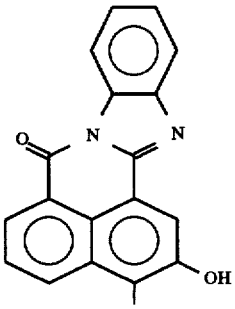 |
| Cp-89 | 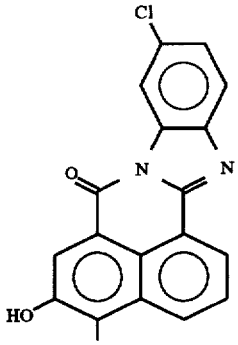 |
| Cp-90 | 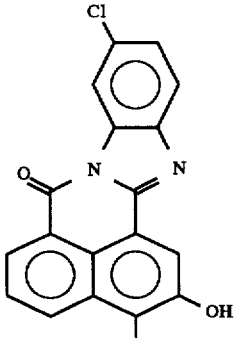 |
| Cp-91 | 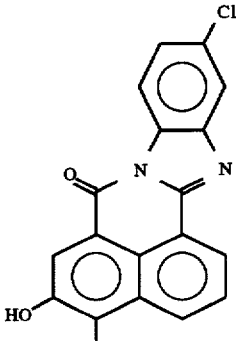 |

TABLE 5-continued
Specific Examples of Couplers Cp and Cp'
| COUPLER NO. | STRUCTURE |
|---|---|
| Cp-92 | 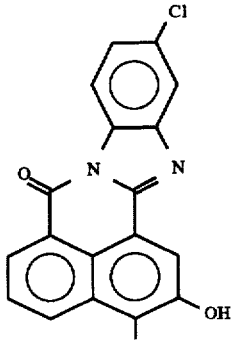 |
TABLE 6
| COUPLER NO. | STRUCTURE |
|---|---|
| Cp-93 | 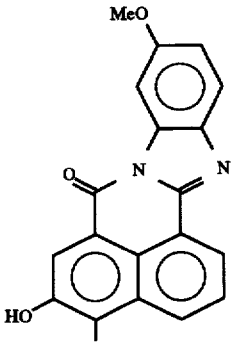 |
| Cp-94 | 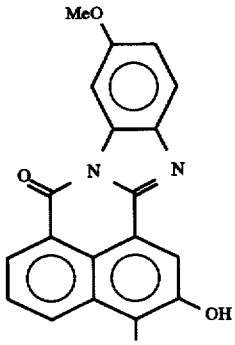 |
| Cp-95 | 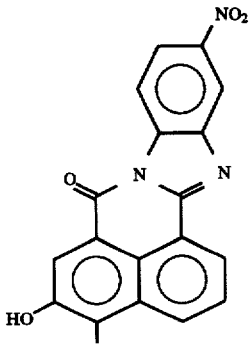 |
TABLE 6-continued
| COUPLER NO. | STRUCTURE |
|---|---|
| Cp-96 | 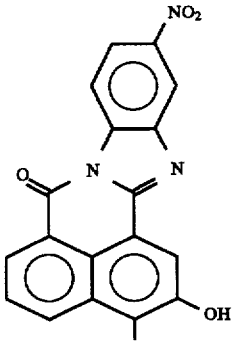 |
| Cp-97 | 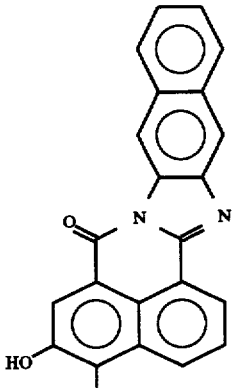 |
| Cp-98 | 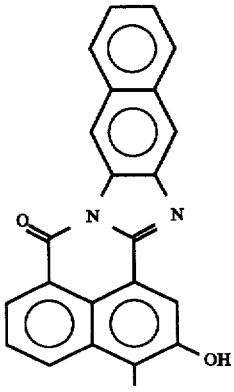 |
| Cp-99 | 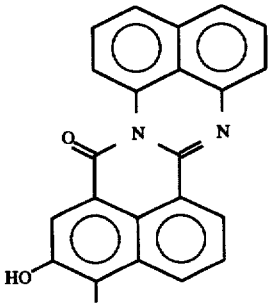 |

TABLE 6-continued

| COUPLER NO. | STRUCTURE |
|---|---|
| Cp-100 | 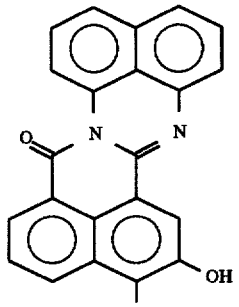 |

TABLE 7

Specific Examples of Azo Pigment Represented by General Formula (A)

| COMPOUND NO. | AZO COMPONENT | Cp | Cp' |
|---|---|---|---|
| Azo-1 | a | Cp-1 | Cp-1 |
| Azo-2 | " | Cp-2 | Cp-2 |
| Azo-3 | " | Cp-17 | Cp-17 |
| Azo-4 | " | Cp-20 | Cp-20 |
| Azo-5 | " | Cp-54 | Cp-54 |
| Azo-6 | " | Cp-75 | Cp-75 |
| Azo-7 | " | Cp-86 | Cp-86 |
| Azo-8 | " | Cp-1 | Cp-86 |
| Azo-9 | " | Cp-88 | Cp-88 |
| Azo-10 | " | Cp-1 | Cp-88 |
| Azo-11 | b | Cp-1 | Cp-1 |
| Azo-12 | " | Cp-5 | Cp-5 |
| Azo-13 | " | Cp-8 | Cp-8 |
| Azo-14 | " | Cp-12 | Cp-12 |
| Azo-15 | " | Cp-12 | Cp-15 |
| Azo-16 | " | Cp-15 | Cp-15 |
| Azo-17 | " | Cp-18 | Cp-18 |
| Azo-18 | " | Cp-29 | Cp-29 |
| Azo-19 | " | Cp-60 | Cp-60 |
| Azo-20 | " | Cp-88 | Cp-88 |

TABLE 8

Specific Examples of Azo Pigment Represented by General Formula (A)

| COMPOUND NO. | AZO COMPONENT | Cp | Cp' |
|---|---|---|---|
| Azo-21 | c | Cp-2 | Cp-2 |
| Azo-22 | " | Cp-5 | Cp-5 |
| Azo-23 | " | Cp-12 | Cp-12 |
| Azo-24 | " | Cp-18 | Cp-18 |
| Azo-25 | " | Cp-33 | Cp-33 |
| Azo-26 | " | Cp-47 | Cp-47 |
| Azo-27 | " | Cp-60 | Cp-60 |
| Azo-28 | " | Cp-72 | Cp-72 |
| Azo-29 | " | Cp-75 | Cp-75 |
| Azo-30 | " | Cp-81 | Cp-81 |
| Azo-31 | d | Cp-2 | Cp-2 |
| Azo-32 | " | Cp-5 | Cp-5 |
| Azo-33 | " | Cp-12 | Cp-12 |
| Azo-34 | " | Cp-18 | Cp-18 |
| Azo-35 | " | Cp-33 | Cp-33 |
| Azo-36 | " | Cp-47 | Cp-47 |
| Azo-37 | " | Cp-60 | Cp-60 |
| Azo-38 | " | Cp-72 | Cp-72 |
| Azo-39 | " | Cp-75 | Cp-75 |
| Azo-40 | " | Cp-81 | Cp-81 |

TABLE 9

Specific Examples of Azo Pigment Represented by General Formula (A)

| COMPOUND NO. | AZO COMPONENT | Cp | Cp' |
|---|---|---|---|
| Azo-41 | e | Cp-2 | Cp-2 |
| Azo-42 | " | Cp-5 | Cp-5 |
| Azo-43 | " | Cp-12 | Cp-12 |
| Azo-44 | " | Cp-18 | Cp-18 |
| Azo-45 | " | Cp-33 | Cp-33 |
| Azo-46 | " | Cp-47 | Cp-47 |
| Azo-47 | " | Cp-60 | Cp-60 |
| Azo-48 | " | Cp-72 | Cp-72 |
| Azo-49 | " | Cp-75 | Cp-75 |
| Azo-50 | " | Cp-81 | Cp-81 |
| Azo-51 | f | Cp-1 | Cp-1 |
| Azo-52 | " | Cp-5 | Cp-5 |
| Azo-53 | " | Cp-7 | Cp-7 |
| Azo-54 | " | Cp-18 | Cp-18 |
| Azo-55 | " | Cp-35 | Cp-35 |
| Azo-56 | " | Cp-47 | Cp-47 |
| Azo-57 | " | Cp-50 | Cp-50 |
| Azo-58 | " | Cp-62 | Cp-62 |
| Azo-59 | " | Cp-72 | Cp-72 |
| Azo-60 | " | Cp-81 | Cp-81 |

As a condensational and polycyclic aromatic pigment, any pigment included in the category may be employed in the present invention. The pigment includes benzanthrone, dibromobenzanthrone, benzyl, dibenzanthrone, isoviolanthoene, dichloroisoviolanthrone, pyranthrone, anthoanthrone, dibromoanthoanthrone, indanthrone and dichloroindanthrone. Moreover, any of various perylene pigment materials may be employed. In particular, dibromanthoanthrone or perylene pigment is preferred, since it is combined with the charge transport polymer according to the present invention, in particular, the charge transport polyester represented by any of general formulas (II) to (IV), a photosensitive member can be obtained which exhibits excellent sensitivity and satisfactory stability and which is free from potential change even if the thickness of the charge transport layer is reduced.

Also a variety of perylene pigment materials have been suggested, for example, symmetric perylene pigment and asymmetric perylene pigment with respect to a short center line. Using a mixture of the symmetric perylene pigment and the asymmetric perylene pigment has been disclosed. In this embodiment, any perylene pigment represented by any one of general formulas (a) to (j) is preferably employed.

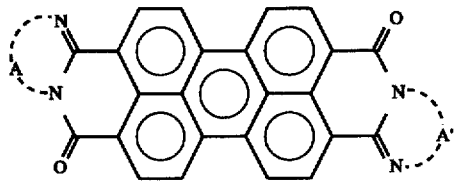

(g)

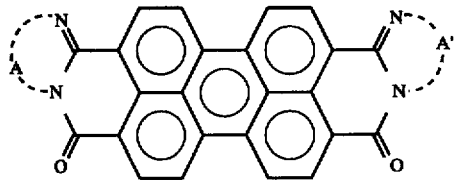

(h)

-continued (i)

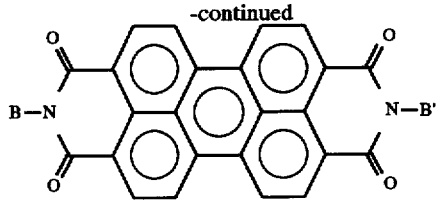

(j)

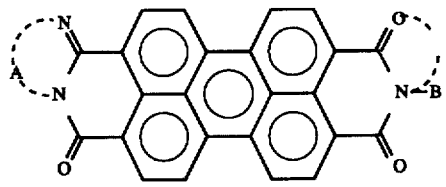

wherein A and A' are each a bivalent aromatic hydrocarbon radical or a bivalent heterocyclic group which may be the same or different from each other, B and B' are each an alkyl group, a substituted or a non-substituted aryl group, or a substituted or a non-substituted aralkyl group which may be the same or different from each other.

The substituent includes halogen, an alkyl group, a nitro group and an alkoxy group.

Specific examples of A, A', B and B' are shown in Tables 10 and 11 and specific examples of perylene pigment are shown in Tables 12 to 14. In the present invention, however, they are not limited to the listed examples. As can be understood from the tables, A and A include, as a typical example, a group containing any one of a benzene ring structure, a pyridine ring structure, a pyrazine ring structure, a pyrimidine ring structure and a naphthalene ring structure, and B and B' includes a group containing a benzene ring structure.

TABLE 10

Specific Examples A and A'

| COMPOUND | STRUCTURE OF A AND A' |
|---|---|
| A-1 | 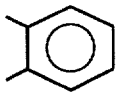 |
| A-2 | 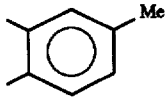 |
| A-3 | 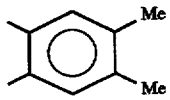 |
| A-4 | 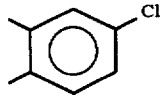 |
| A-5 | 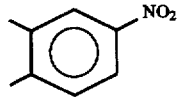 |
| A-6 | 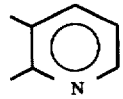 |

TABLE 10-continued

Specific Examples A and A'

| COMPOUND | STRUCTURE OF A AND A' |
|---|---|
| A-7 | 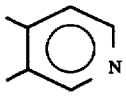 |
| A-8 | 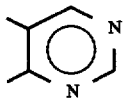 |
| A-9 | 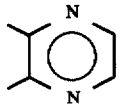 |
| A-10 | 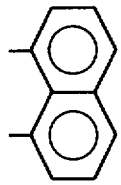 |

TABLE 11

Specific Examples B and B'

| COMPOUND | STRUCTURE OF B AND B' |
|---|---|
| B-1 | 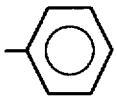 |
| B-2 | 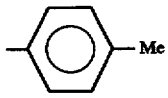 |
| B-3 | 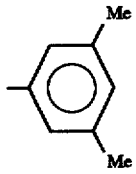 |
| B-4 | 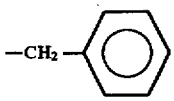 |
| B-5 | 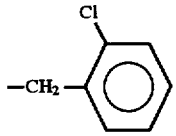 |
| B-6 | 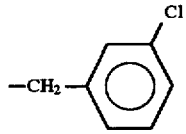 |

TABLE 11-continued

Specific Examples B and B'

| COMPOUND | STRUCTURE OF B AND B' |
|---|---|
| B-7 | 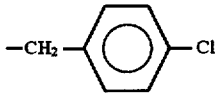 |
| B-8 | 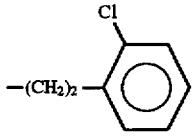 |
| B-9 | 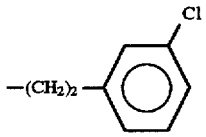 |
| B-10 | 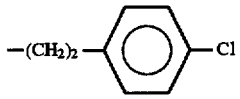 |
| B-11 | 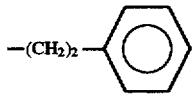 |
| B-12 | 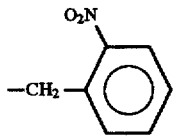 |
| B-13 | 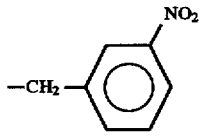 |
| B-14 | 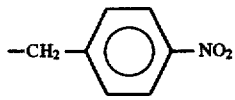 |
| B-15 | 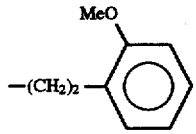 |
| B-16 | 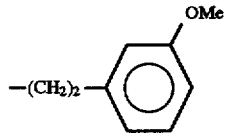 |
| B-17 | 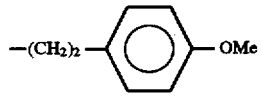 |
| B-18 | 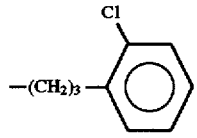 |

TABLE 11-continued

Specific Examples B and B'

| COMPOUND | STRUCTURE OF B AND B' |
|---|---|
| B-19 | 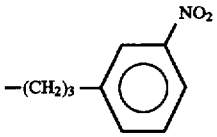 |
| B-20 | 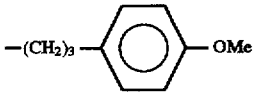 |

TABLE 12

Specific Examples of Perylene Pigment Represented by General Formula (g) or (h)

| COMPOUND | STRUCTURE OF A AND A' |
|---|---|
| P-1 | A-1 |
| P-2 | A-2 |
| P-3 | A-3 |
| P-4 | A-4 |
| P-5 | A-5 |
| P-6 | A-6 |
| P-7 | A-7 |
| P-8 | A-8 |
| P-9 | A-9 |
| P-10 | A-10 |
| P-11 | A-1,A-2 |
| P-12 | A-1,A-4 |

TABLE 13

Specific Examples of Perylene Pigment Represented by General Formula (i)

| COMPOUND | STRUCTURE OF B AND B' | COMPOUND | STRUCTURE OF B AND B' |
|---|---|---|---|
| P-13 | B-1 | P-24 | B-12 |
| P-14 | B-2 | P-25 | B-13 |
| P-15 | B-3 | P-26 | B-14 |
| P-16 | B-4 | P-27 | B-15 |
| P-17 | B-5 | P-28 | B-16 |
| P-18 | B-6 | P-29 | B-17 |
| P-19 | B-7 | P-30 | B-18 |
| P-20 | B-8 | P-31 | B-19 |
| P-21 | B-9 | P-32 | B-20 |
| P-22 | B-10 | P-33 | B-5,B-11 |
| P-23 | B-11 | P-34 | B-8,B-18 |

TABLE 14

Specific Examples of Perylene Pigment Represented by General Formula (j)

| COMPOUND | STRUCTURE OF A AND B |
|---|---|
| P-35 | A-1,B-6 |
| P-36 | A-1,B-11 |
| P-37 | A-1,B-18 |
| P-38 | A-3,B-18 |
| P-39 | A-5,B-23 |
| P-40 | A-5,B-29 |
| P-41 | A-7,B-3 |

TABLE 14-continued

| Specific Examples of Perylene Pigment Represented by General Formula (i) | |
|---|---|
| COMPOUND | STRUCTURE OF A AND B |
| P-42 | A-8,B-20 |
| P-43 | A-10,B-5 |
| P-44 | A-10,B-11 |

In view of realizing a wide sensitive wavelength and being easily synthesized and easily matched with the charge transport polymer, it is preferable that bisazo pigment be employed and perylene pigment is ranked next.

The charge transport polymer for use in the present invention will now be described. The polymer is a resin containing, as a partial structure of repeated units thereof, at least one of structures respectively represented by the general formulas (I-1) and (I-2).

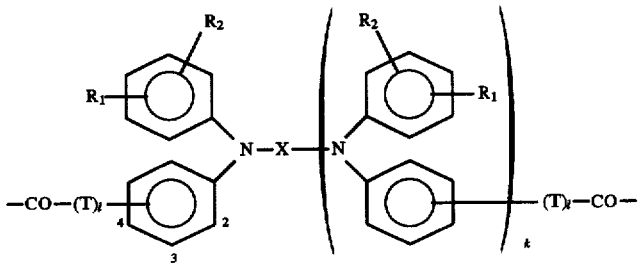

(I-1)

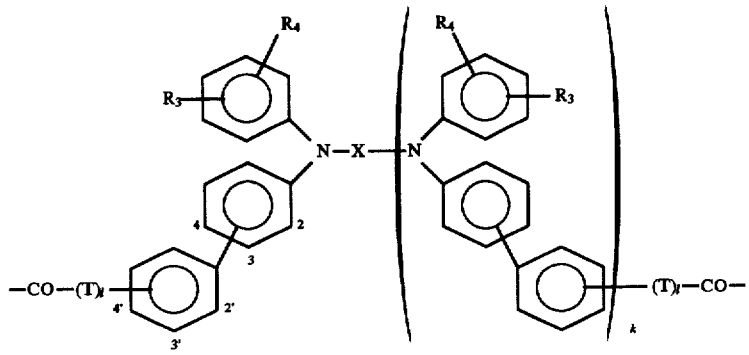

(I-2)

wherein $R_1$ to $R_4$ are each independently, a hydrogen atom, an alkyl group, an alkoxy group, a substituted amino group, halogen or a substituted or a non-substituted aryl group, X is a substituted or a non-substituted bivalent aromatic group, k and L are each an integer of 0 or 1 and T is a hydrocarbon radical having 1 to 10 carbon atoms and permitted to be branched.

Preferably, the alkyl group has 1 to 4 carbon atoms (for example, a methyl group, an ethyl group, a n-propyl group, an iso-propyl group, a n-butyl group or a t-butyl group), the alkoxy group has 1 to 4 carbon atoms (for example, a methoxy group, an ethoxy group, a propoxy group or a butoxy group), the substituted amino group is, for example, a dimethylamino group, a diethylamino group or a dibutylamino group, halogen is chlorine, bromine, fluorine or iodine and the aryl group has 6 to 14 carbon atoms (for example, a phenyl group, a naphthyl group, a biphenyl group or an anthryl group).

The substituent includes an alkyl group, an alkoxy group, halogen and a nitro group, specifically a methyl group, an ethyl group, a methoxy group, fluorine and chlorine.

Most preferably, $R_1$ to $R_4$ are each independently an alkyl group, an alkoxy group or a phenyl group. Specifically, a methyl group, an ethyl group and a methoxy group are exemplified.

In general formulas (I-1) or (I-2), it is preferable that X be selected from a group consisting of the following groups (1) to (7).

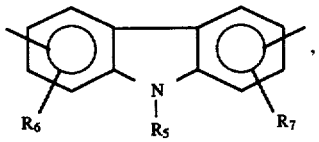

(1)

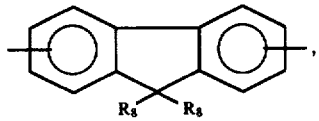

(2)

-continued

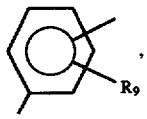

(3)

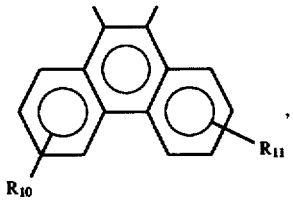

(4)

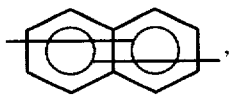

(5)

-continued (6)

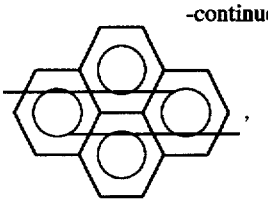

(7)

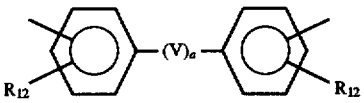

wherein $R_5$ is a hydrogen atom, an alkyl group having one to four carbon atoms, a substituted or a non-substituted phenyl group, or a substituted or a non-substituted aralkyl group, $R_6$ to $R_{12}$ are each independently a hydrogen atom, an alkyl group having one to four carbon atoms, an alkoxy group having one to four carbon atoms, a substituted or a non-substituted phenyl group or a substituted or a non-substituted aralkyl group or halogen, a is 0 or 1, and V is a material selected from a group consisting of the following groups (8) to (17).

$-(CH_2)_b-$, (8)

$-C(CH_3)_2-$, (9)

$-O-$, (10)

$-S-$, (11)

(12)

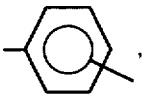

(13)

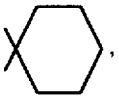

$-C(CF_3)_2-$, (14)

$-Si(CH_3)_2-$, (15)

$-CH=CH-$, (16)

(17)

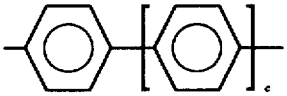

wherein b is an integer from 1 to 10 and c is an integer from 1 to 3.

The substituent is the same as the foregoing substituent.

In particular, a polymer wherein X has a biphenyl structure has excellent mobility and thus exhibiting satisfactory serviceability as reported in "The Sixth International Congress on Advances in Non-impact Printing Technologies, 306, (1990)".

In general formulas (I-1) or (I-2), T is a bivalent hydrocarbon radical having 1 to 10 carbon atoms and permitted to be branched. Specific examples of its structure are as below. The aryl amine skeleton may be bonded to either side of the structure. In the description below, expression as T-5r indicates that the aryl amine skeleton is bonded to the right-hand side of the structure T-5 and that as T-5l indicates that the aryl amine skeleton is bonded to the left-hand side of the structure T-5 (refer to Tables 15 to 20).

$-CH_2-$, $-(CH_2)_2-$, $-\overset{CH_3}{\overset{|}{CH}}-$, $-(CH_2)_3-$,

T-1 T-2 T-3 T-4

-continued $-\overset{CH_3}{\overset{|}{CH}}-CH_2-$, $-\overset{CH_3}{\overset{|}{\underset{CH_3}{\underset{|}{C}}}}-$, $-(CH_2)_4-$, $-\overset{CH_3}{\overset{|}{CH}}-\underset{CH_3}{\underset{|}{CH}}-$,

T-5 T-6 T-7 T-8

$-\overset{CH_3}{\overset{|}{\underset{CH_3}{\underset{|}{C}}}}-CH_2-$, $-\overset{CH_3}{\overset{|}{CH}}-CH_2-CH_2-$, $-CH_2-\overset{CH_3}{\overset{|}{CH}}-CH_2-$

T-9 T-10 T-11

$-(CH_2)_5-$, $-\overset{C_2H_5}{\overset{|}{CH}}-\underset{CH_3}{\underset{|}{CH}}-$, $-\overset{C_3H_7}{\overset{|}{CH}}-CH_2-$,

T-12 T-13 T-14

$-\overset{CH_3}{\overset{|}{\underset{CH_3}{\underset{|}{C}}}}-CH_2-CH_2-$, $-\overset{CH_3}{\overset{|}{CH}}-\underset{CH_3}{\underset{|}{CH}}-CH_2-$

T-15 T-16

$-\overset{CH_3}{\overset{|}{CH}}-CH_2-\underset{CH_3}{\underset{|}{CH}}-$, $-CH_2-\overset{CH_3}{\overset{|}{\underset{CH_3}{\underset{|}{C}}}}-CH_2-$,

T-17 T-18

$-\overset{CH_3}{\overset{|}{CH}}-CH_2-CH_2-CH_2-$, $-CH_2-\overset{CH_3}{\overset{|}{CH}}-CH_2-CH_2-$

T-19 T-20

$-\overset{CH_3}{\overset{|}{CH}}-CH_2-CH_2-CH_2-CH_2-$,

T-21

$-CH_2-\overset{CH_3}{\overset{|}{CH}}-CH_2-CH_2-CH_2-$,

T-22

$-CH_2-CH_2-\overset{CH_3}{\overset{|}{CH}}-CH_2-CH_2-$,

T-23

$-CH_2-\overset{CH_3}{\overset{|}{\underset{CH_3}{\underset{|}{C}}}}-CH_2-CH_2-$,

T-24

$-CH_2-\overset{CH_3}{\overset{|}{CH}}-CH_2-CH_2-CH_2-CH_2-$,

T-25

-continued

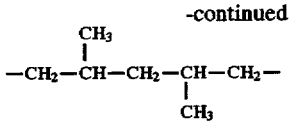

T-26

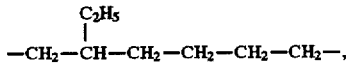

T-27

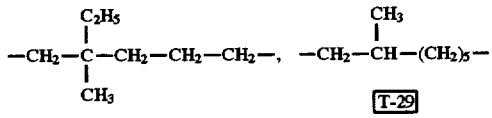

T-28 T-29

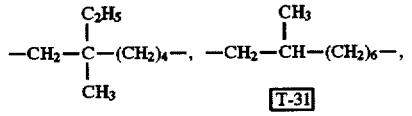

T-30 T-31

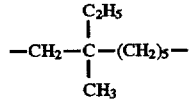

T-32

The charge transport polymer represented by the foregoing formulas is a charge transport polyester resin represented by any one of the following general formulas (II) to (IV). That is, it is a charge transport polyester resin containing at least one of structures represented by the foregoing general formulas (I-1) and (I-2), and represented by the following general formula (II) or (III); or a random copolymer containing at least one off structures represented by the general formulas (I-1) and (I-2), and at least one of dicarboxylic acid components represented by —O—CO—Z—CO—O—, and represented by the following general formula (IV).

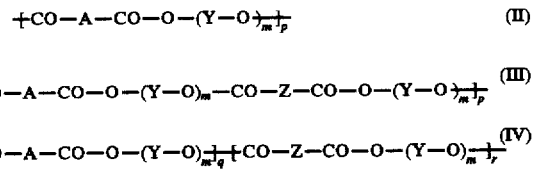

(II)

(III)

(IV)

wherein A is a structure represented by the foregoing general formula (I-1) or (I-2), Y and Z are each independently a bivalent hydrocarbon radical, m is or m's are each independently an integer from 1 to 5, p is an integer from 5 to 5,000, q is an integer from 1 to 5,000, r is an integer from 1 to 3,500 and q+r is an integer from 5 to 5,000 wherein $0.3 \leqq q/(q+r) < 1$.

It is preferable that the preferred charge transport polyester resin has Y and Z each of which is selected from the group consisting of the following groups (18) to (24):

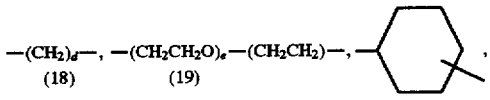

(18) (19) (20)

-continued

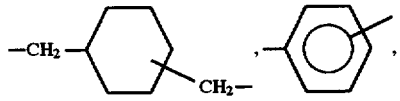

(21) (22)

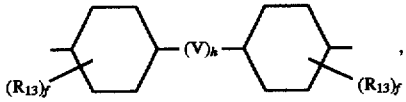

(23)

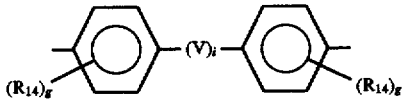

(24)

wherein $R_{13}$ and $R_{14}$ are each independently a hydrogen atom, an alkyl group having 1 to 4 carbon atoms, an alkoxy group having 1 to 4 carbon atoms, a substituted or a non-substituted phenyl group, a substituted or a non-substituted aralkyl group or halogen, d and e are each an integer from 1 to 10, f and g are each an integer from 0 to 2, h and i are each 1 or 2 and V is the same as the foregoing.

The substituent is the same as the foregoing substituent.

Examples of the constitutional formulas (I-1) and (I-2) are shown in Tables 15 to 17 and 18 to 20, respectively. Examples of specific compounds of the charge transport polyester resin represented by any one of general formulas (II) to (IV) are shown in Tables 21 to 24. In the present invention, however, they are not limited to the listed examples.

TABLE 15

Specific Examples of Partial Constitutional Formula Represented by General Formula (I-1)

| PC | X | $R_1$ | $R_2$ | B | k | T |
|---|---|---|---|---|---|---|
| 1 | 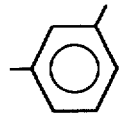 | H | H | 3 | 0 | T-2 |
| 2 | 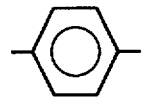 | H | H | 3 | 0 | T-2 |
| 3 | 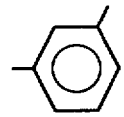 | 3-Me | 4-Me | 3 | 0 | T-2 |
| 4 | 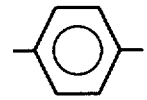 | 3-Me | 4-Me | 4 | 0 | T-2 |
| 5 | 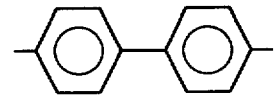 | H | H | 3 | 1 | — |

TABLE 15-continued
Specific Examples of Partial Constitutional Formula Represented by General Formula (I-1)
| PC | X | $R_1$ | $R_2$ | B | k | T |
|---|---|---|---|---|---|---|
| 6 | 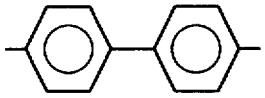 | H | H | 3 | 1 | T-2 |
| 7 | 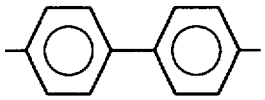 | H | H | 3 | 1 | T-51 |
| 8 | 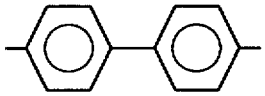 | H | 4-Me | 3 | 1 | T-2 |
| 9 | 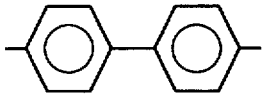 | H | 4-Ph | 3 | 1 | T-2 |
| 10 | 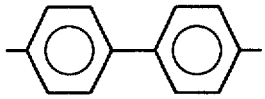 | 3-Me | 4-Me | 3 | 1 | T-81 |
| 11 | 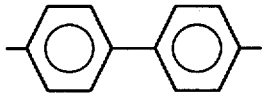 | 3-Me | 4-Me | 3 | 1 | T-251 |
| 12 | 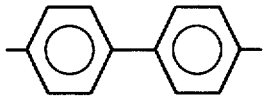 | H | H | 4 | 1 | T-5r |
| 13 | 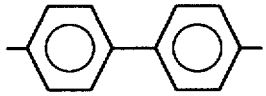 | H | H | 4 | 1 | T-1 |
| 14 | 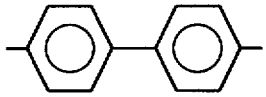 | H | H | 4 | 1 | T-2 |
In Tables 15–20,
PC: Partial Constitutional Formula
B: Bonding Position
TABLE 16
| PC | X | $R_1$ | $R_2$ | B | k | T |
|---|---|---|---|---|---|---|
| 15 | 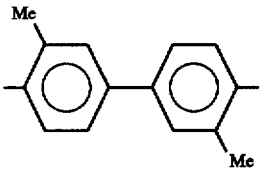 | 3-Me | 4-Me | 3 | 1 | — |
| 16 | 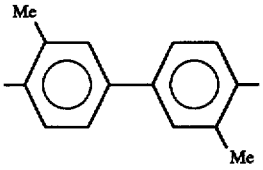 | H | H | 3 | 1 | T-2 |
TABLE 16-continued
| PC | X | $R_1$ | $R_2$ | B | k | T |
|---|---|---|---|---|---|---|
| 17 | 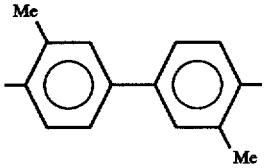 | H | 4-Me | 3 | 1 | T-2 |
| 18 | 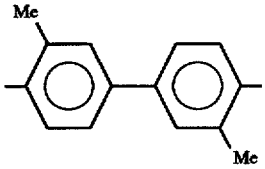 | 3-Me | 4-Me | 4 | 1 | T-1 |
| 19 | 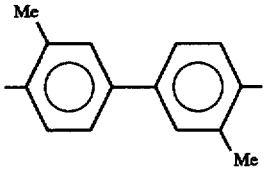 | 3-Me | 4-Me | 4 | 1 | T-2 |
| 20 | 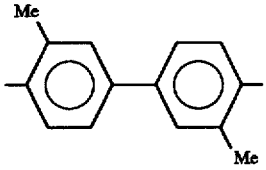 | 3-Me | 4-Me | 4 | 1 | T-4 |
| 21 | 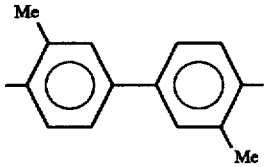 | 3-Me | 5-Me | 4 | 1 | T-2 |
| 22 | 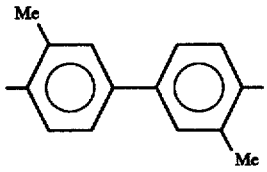 | 3-Me | 4-Me | 4 | 1 | T-51 |
| 23 | 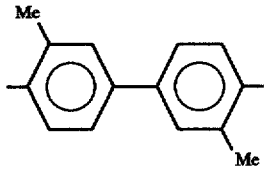 | 4-Me | H | 4 | 1 | T-131 |
| 24 | 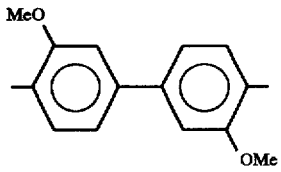 | H | H | 3 | 1 | — |

TABLE 16-continued
| PC | X | $R_1$ | $R_2$ | B | k | T |
|---|---|---|---|---|---|---|
| 25 | 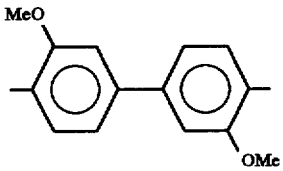 | H | H | 3 | 1 | T-2 |
| 26 | 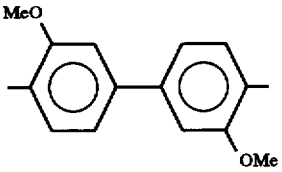 | H | 4-Me | 3 | 1 | T-2 |
TABLE 16-continued
| PC | X | $R_1$ | $R_2$ | B | k | T |
|---|---|---|---|---|---|---|
| 27 | 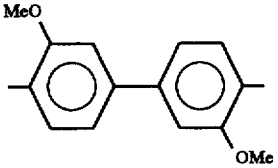 | H | 4-Ph | 3 | 1 | T-2 |
| 28 | 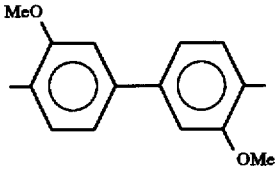 | 3-Me | 4-Me | 3 | 1 | T-81 |
TABLE 17
| PC | X | $R_1$ | $R_2$ | B | k | T |
|---|---|---|---|---|---|---|
| 29 | 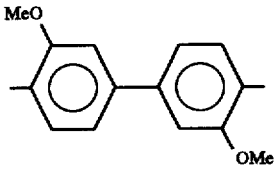 | 3-Me | 4-Me | 3 | 1 | T-251 |
| 30 | 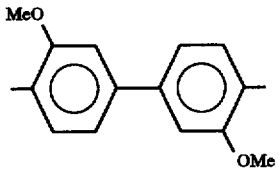 | H | H | 4 | 1 | T-5r |
| 31 | 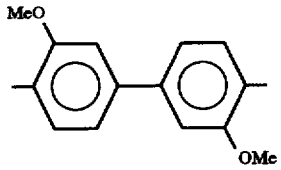 | 3-Me | 4-Me | 4 | 1 | T-2 |
| 32 | 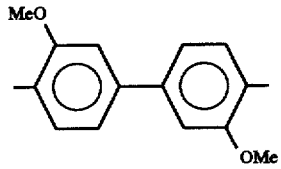 | 4-Me | H | 4 | 1 | T-171 |
| 33 | 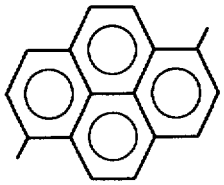 | H | H | 3 | 1 | T-2 |

TABLE 17-continued
| PC | X | $R_1$ | $R_2$ | B | k | T |
|---|---|---|---|---|---|---|
| 34 | 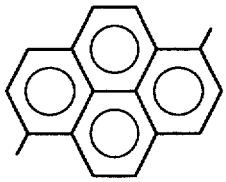 | H | 4-Me | 3 | 1 | T-81 |
| 35 | 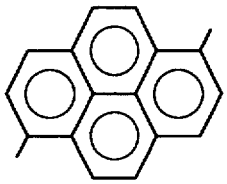 | 3-Me | 4-Me | 3 | 1 | T-181 |
| 36 | 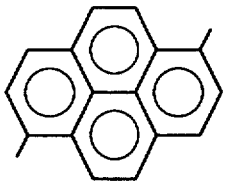 | H | H | 4 | 1 | T-201 |
| 37 | 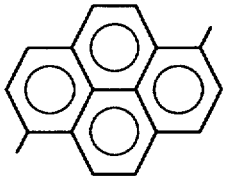 | 4-Me | H | 4 | 1 | T-241 |
| 38 | 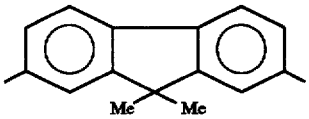  | H | H | 3 | 1 | T-2 |
| 39 | 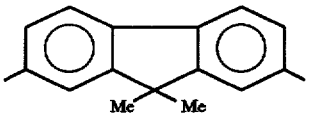  | H | 4-Me | 3 | 1 | T-81 |
| 40 | 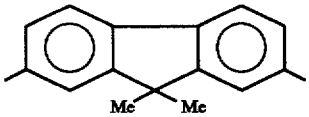  | 3-Me | 4-Me | 3 | 1 | T-181 |
| 41 | 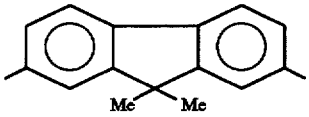  | H | H | 4 | 1 | T-201 |
| 42 | 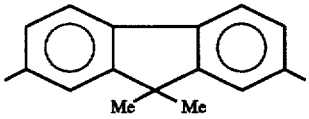  | 4-Me | H | 4 | 1 | T-241 |

TABLE 18
Specific Examples of Partial Constitutional Formula Represented by General Formula (I-2)
| PC | X | $R_1$ | $R_2$ | B | k | T |
|---|---|---|---|---|---|---|
| 43 | 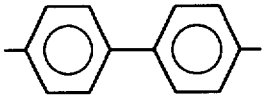 | H | H | 4,4' | 0 | T-1 |
| 44 | 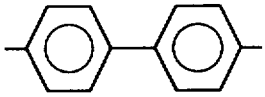 | H | H | 4,4' | 0 | T-2 |
| 45 | 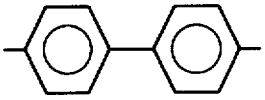 | 3-Me | 4-Me | 4,4' | 0 | — |
| 46 | 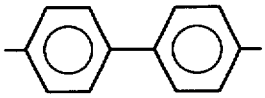 | 3-Me | 4-Me | 4,4' | 0 | T-2 |
| 47 | 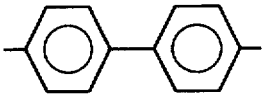 | H | H | 4,4' | 1 | T-1 |
| 48 | 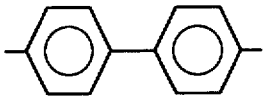 | H | H | 4,4' | 1 | T-2 |
| 49 | 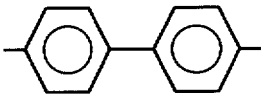 | H | H | 4,4' | 1 | T-5l |
TABLE 18-continued
Specific Examples of Partial Constitutional Formula Represented by General Formula (I-2)
| PC | X | $R_1$ | $R_2$ | B | k | T |
|---|---|---|---|---|---|---|
| 50 | 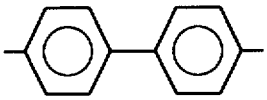 | H | 4-Me | 4,4' | 1 | T-2 |
| 51 | 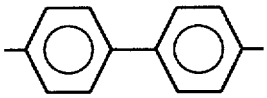 | H | 4-Ph | 4,4' | 1 | T-2 |
| 52 | 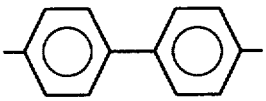 | 3-Me | 4-Me | 4,4' | 1 | T-8l |
| 53 | 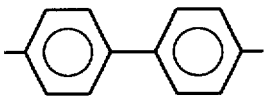 | 3-Me | 4-Me | 4,4' | 1 | T-25l |
| 54 | 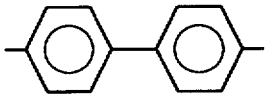 | H | H | 4,4' | 1 | T-5r |
| 55 | 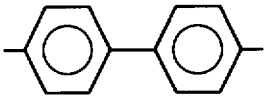 | 3-Me | 4-Me | 4,4' | 1 | T-1 |
| 56 | 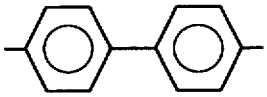 | 4-Me | H | 4,4' | 1 | T-2 |
TABLE 19
| PC | X | $R_1$ | $R_2$ | B | k | T |
|---|---|---|---|---|---|---|
| 57 | 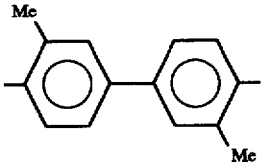 | H | H | 4,4' | 1 | — |
| 58 | 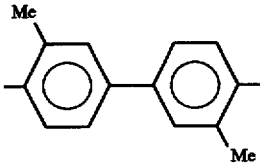 | H | H | 4,4' | 1 | T-2 |
| 59 | 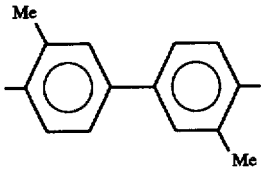 | H | 4-Me | 4,4' | 1 | T-2 |

TABLE 19-continued
| PC | X | $R_1$ | $R_2$ | B | k | T |
|---|---|---|---|---|---|---|
| 60 | 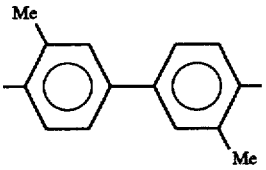 | H | 4-Ph | 4,4' | 1 | T-1 |
| 61 | 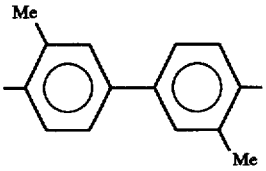 | 3-Me | 4-Me | 4,4' | 1 | T-2 |
| 62 | 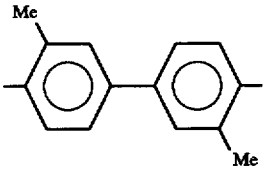 | 3-Me | 4-Me | 4,4' | 1 | T-4 |
| 63 | 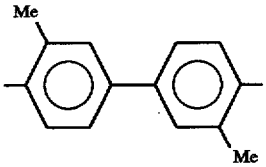 | H | H | 4,4' | 1 | T-5r |
| 64 | 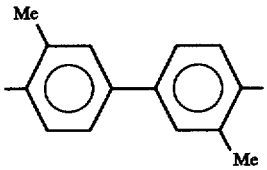 | 3-Me | 4-Me | 4,4' | 1 | T-5l |
| 65 | 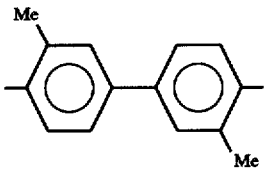 | 4-Me | H | 4,4' | 1 | T-13l |
| 66 | 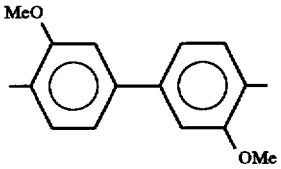 | H | H | 4,4' | 1 | — |
| 67 | 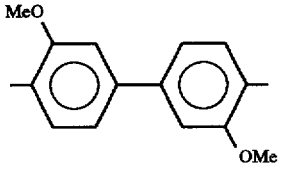 | H | H | 4,4' | 1 | T-2 |

TABLE 19-continued
| PC | X | $R_1$ | $R_2$ | B | k | T |
|---|---|---|---|---|---|---|
| 68 | 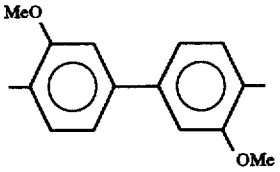 | H | 4-Me | 4,4' | 1 | T-2 |
| 69 | 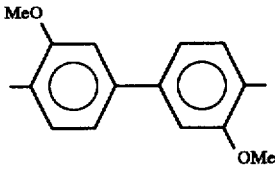 | H | 4-Ph | 4,4' | 1 | T-2 |
| 70 | 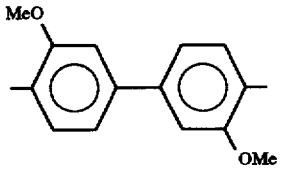 | 3-Me | 4-Me | 4,4' | 1 | T-8l |
TABLE 20
| PC | X | $R_1$ | $R_2$ | B | k | T |
|---|---|---|---|---|---|---|
| 71 | 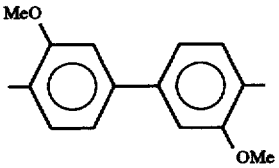 | 3-Me | 4-Me | 4,4' | 1 | T-25l |
| 72 | 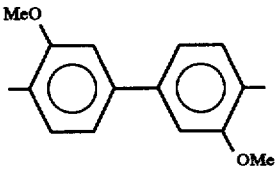 | H | H | 4,4' | 1 | T-5r |
| 73 | 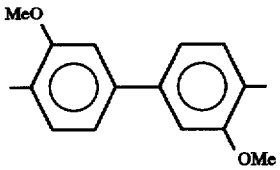 | 3-Me | 4-Me | 4,4' | 1 | T-2 |
| 74 | 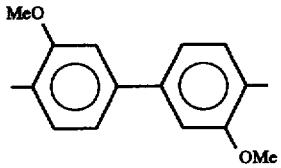 | 4-Me | H | 4,4' | 1 | T-17l |
| 75 | 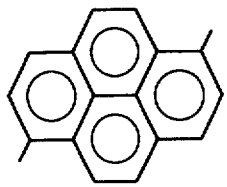 | H | H | 4,4' | 1 | T-2 |

TABLE 20-continued
| PC | X | $R_1$ | $R_2$ | B | k | T |
|---|---|---|---|---|---|---|
| 76 | 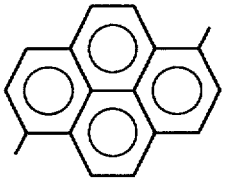 | H | 4-Me | 4,4' | 1 | T-81 |
| 77 | 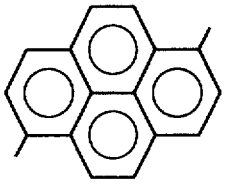 | 3-Me | 4-Me | 4,4' | 1 | T-181 |
| 78 | 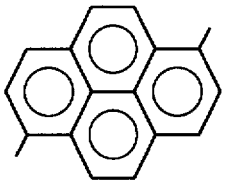 | H | H | 4,4' | 1 | T-201 |
| 79 | 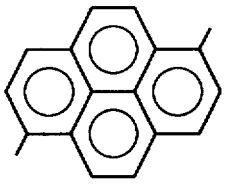 | 4-Me | H | 4,4' | 1 | T-241 |
| 80 | 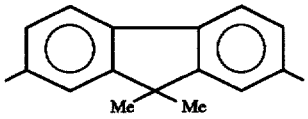  | H | H | 4,4' | 1 | T-2 |
| 81 | 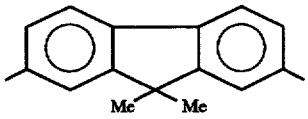  | H | 4-Me | 4,4' | 1 | T-81 |
| 82 | 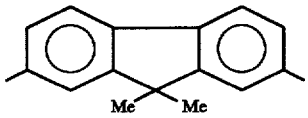  | 3-Me | 4-Me | 4,4' | 1 | T-181 |
| 83 | 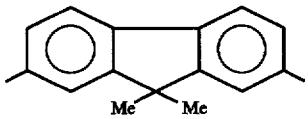  | H | H | 4,4' | 1 | T-201 |
| 84 | 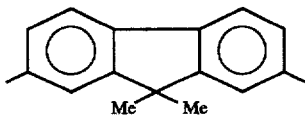  | 4-Me | H | 4,4' | 1 | T-241 |

TABLE 21

Specific Examples of Charge transport Polymer Represented by General Formula (II)

| COMPOUND | PARTIAL STRUCTURE (A) STRUCTURE | RATIO | Y | m | p |
|---|---|---|---|---|---|
| CTP-1 | 6 | — | $-CH_2CH_2-$ | 1 | 165 |
| CTP-2 | 6 | — | $-CH_2CH_2-$ | 2 | 55 |
| CTP-3 | 6 | — | 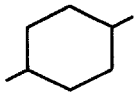 | 1 | 35 |
| CTP-4 | 6 | — | 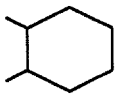 | 1 | 40 |
| CTP-5 | 6 | — | 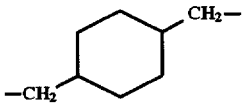 | 1 | 30 |
| CTP-6 | 3 | — | $-CH_2CH_2-$ | 1 | 230 |
| CTP-7 | 19 | — | $-CH_2CH_2-$ | 1 | 165 |
| CTP-8 | 21 | — | $-CH_2CH_2-$ | 1 | 150 |
| CTP-9 | 26 | — | $-CH_2CH_2-$ | 1 | 200 |
| CTP-10 | 33 | — | $-CH_2CH_2-$ | 2 | 60 |
| CTP-11 | 39 | — | $-CH_2CH_2-$ | 1 | 145 |

TABLE 22

Specific Examples of Charge transport Polymer Represented by General Formula (II)

| COMPOUND | PARTIAL STRUCTURE (A) STRUCTURE | RATIO | Y | m | p |
|---|---|---|---|---|---|
| CTP-12 | 46 | — | $—CH_2CH_2—$ | 1 | 210 |
| CTP-13 | 47 | — | $—CH_2CH_2—$ | 1 | 140 |
| CTP-14 | 48 | — | $—CH_2CH_2—$ | 1 | 150 |
| CTP-15 | 61 | — | $—CH_2CH_2—$ | 1 | 175 |
| CTP-16 | 68 | — | $—CH_2CH_2—$ | 1 | 175 |
| CTP-17 | 73 | — | $—CH_2CH_2—$ | 1 | 180 |
| CTP-18 | 6/19 | 1/1 | $—CH_2CH_2—$ | 1 | 200 |

TABLE 22-continued

Specific Examples of Charge transport Polymer Represented by General Formula (II)

| COMPOUND | PARTIAL STRUCTURE (A) STRUCTURE | RATIO | Y | m | p |
|---|---|---|---|---|---|
| CTP-19 | 6/48 | 1/1 | $—CH_2CH_2—$ | 1 | 170 |
| CTP-20 | 22/47 | 1/1 | $—CH_2CH_2—$ | 1 | 160 |
| CTP-21 | 22/48 | 1/1 | $—CH_2CH_2—$ | 1 | 155 |
| CTP-22 | 22/75 | 1/1 | $—CH_2CH_2—$ | 1 | 180 |

TABLE 23

Specific Examples of Charge transport Polymer Represented by General Formula (III)

| COMPOUND | PARTIAL STRUCTURE (A) STRUCTURE | RATIO | Y | Z | m | p |
|---|---|---|---|---|---|---|
| CTP-23 | 6 | — | $-CH_2CH_2-$ | 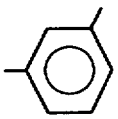 | 1 | 20 |
| CTP-24 | 6 | — | $-CH_2CH_2-$ | 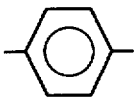 | 1 | 15 |

TABLE 23-continued

Specific Examples of Charge transport Polymer Represented by General Formula (III)

| COMPOUND | PARTIAL STRUCTURE (A) STRUCTURE | RATIO | Y | Z | m | p |
|---|---|---|---|---|---|---|
| CTP-25 | 19 | — | $-CH_2CH_2-$ | 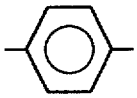 | 1 | 35 |
| CTP-26 | 19 | — | $-CH_2CH_2-$ | $-CH_2CH_2-$ | 1 | 45 |
| CTP-27 | 19 | — | 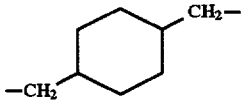 | 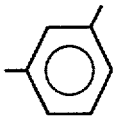 | 1 | 20 |
| CTP-28 | 48 | — | $-CH_2CH_2-$ | 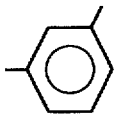 | 1 | 15 |

TABLE 24

Specific Examples of Charge transport Polymer Represented by General Formula (IV)

| COMPOUND | PARTIAL STRUCTURE (A) STRUCTURE | RATIO | Y | m | Z | q | r |
|---|---|---|---|---|---|---|---|
| CTP-29 | 6 | — | $-CH_2CH_2-$ | 1 | $-(CH_2)_4-$ | 140 | 35 |
| CTP-30 | 6 | — | $-CH_2CH_2-$ | 2 | $-(CH_2)_4-$ | 115 | 15 |
| CTP-31 | 6 | — | $-CH_2CH_2-$ | 1 | $-(CH_2)_8-$ | 150 | 30 |
| CTP-32 | 19 | — | $-CH_2CH_2-$ | 1 | $-(CH_2)_8-$ | 90 | 60 |
| CTP-33 | 19 | — | $-CH_2CH_2-$ | 1 | 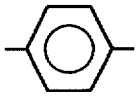 | 110 | 70 |
| CTP-34 | 19/21 | 1/1 | $-CH_2CH_2-$ | 1 | $-(CH_2)_8-$ | 110 | 40 |
| CTP-35 | 17 | — | $-CH_2CH_2-$ | 1 | $-(CH_2)_4-$ | 85 | 85 |
| CTP-36 | 17 | — | $-CH_2CH_2-$ | 2 | $-(CH_2)_4-$ | 45 | 45 |
| CTP-37 | 17 | — | $-CH_2CH_2-$ | 1 | $-(CH_2)_8-$ | 80 | 40 |
| CTP-38 | 38 | — | $-CH_2CH_2CH_2-$ | 1 | 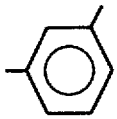 | 60 | 30 |
| CTP-39 | 47 | — | $-CH_2CH_2-$ | 1 | $-(CH_2)_4-$ | 130 | 30 |
| CTP-40 | 47 | — | $-CH_2CH_2-$ | 1 | $-(CH_2)_{10}-$ | 130 | 10 |
| CTP-41 | 48 | — | $-CH_2CH_2-$ | 1 | $-(CH_2)_4-$ | 115 | 50 |
| CTP-42 | 48 | — | $-CH_2CH_2-$ | 1 | $-(CH_2)_6-$ | 120 | 30 |
| CTP-43 | 75 | — | $-CH_2CH_2-$ | 3 | $-(CH_2)_8-$ | 60 | 20 |
| CTP-44 | 19/47 | 1/1 | $-CH_2CH_2-$ | 1 | $-(CH_2)_8-$ | 80 | 40 |
| CTP-45 | 21/48 | 1/1 | $-CH_2CH_2CH_2-$ | 1 | $-(CH_2)_8-$ | 80 | 60 |
| CTP-46 | 21/61 | 1/1 | $-CH_2CH_2-$ | 1 | $-(CH_2)_6-$ | 110 | 40 |

The method of preparing the charge transport resin has been disclosed in the foregoing documents. Then, examples of the method of preparing the charge transport polyester will now be described. By using at least one charge transport monomer represented by the following constitutional formula (V) or (VI) and employing a known polymerizing method disclosed in, for example, Vol. 28, 4-th edition of "Experimental Chemistry", the charge transport polyester can be prepared.

(V)

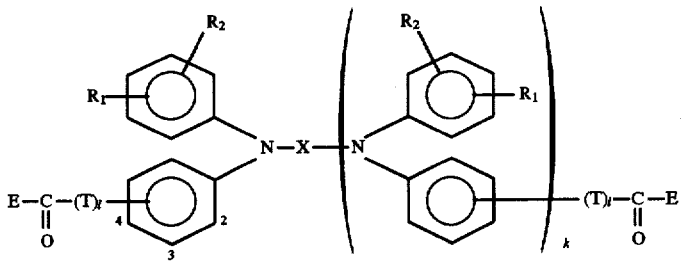

(VI)

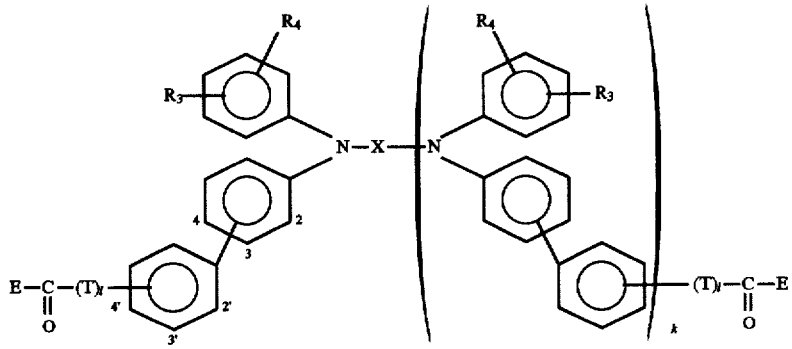

wherein $R_1$ to $R_4$, X, k, l and T are as described above, E is a hydroxyl group, a halogen atom or group —O—$R_{15}$ (wherein $R_{15}$ is an alkyl group, a substituted or a non-substituted aryl group or an aralkyl group).

The method of preparing the charge transport polymer will be described in respective cases where E is a hydroxyl group, where the same is halogen anti where the same is ester. Among the respective methods, it is preferable that E is ester, in view of raising the degree of polymerization of the polymer and easily preparing the polymer.

(1) In a Case Where E is Hydroxyl Group

In a case where E of the moromer is a hydroxyl group, dihydric alcohols represented by HO—(Y—O)m—H are mixed with the monomer in substantially equivalent amounts, and then polymerization is performed by using an acid catalyst. The acid catalyst may be any acid catalyst for use in a usual esterification reaction, for example, sulfuric acid, toluene sulfonic acid or trifluoroacetic acid. The acid catalyst is used in a range from 1/10000 parts by weight to 1/10 parts by weight, preferably 1/1000 parts by weight to 1/50 parts by weight with respect to 1 part by weight of the charge transport monomer. To remove water generated during the polymerization process, it is preferable that a solvent azeotropic with respect to water be employed. It is effective to employ toluene, chlorobenzene or 1-chloronaphthalene. The solvent is used by 1 part by weight to 100 parts by weight, preferably 2 parts by weight to 50 parts by weight with respect to 1 part by weight off the charge transport moromet. Although the reaction temperature may arbitrarily be set, it is preferable for removing water during polymerization that the reaction be performed at the boiling point of the solvent.

After the reaction has been completed, the solution is dissolved in a solvent capable off solving the solution if any solvent is not used during the reaction. If the solvent is used during the reaction, the reaction solution is, as it is, dropped into a poor solvent, such as alcohol including methanol and ethanol or acetone, in which the polymer cannot easily be dissolved, so that the charge transport polymer is precipitated and isolated. Then, the charge transport polymer is washed with water or an organic solvent, and then the charge transport polymer is dried. If necessary, a re-precipitation process may be repeated in which the charge transport polymer is dissolved in an appropriate organic solvent; and then dropped into a poor solvent to precipiate the charge transport polymer. When the re-precipitation process is performed, it is preferable that the solution be stirred efficiently by using a mechanical stirrer or the like. The solvent for dissolving the charge transport polymer when the re-precipitation process is performed is used by 1 part by weight to 100 parts by weight, preferably 2 parts by weight to 50 parts by weight with respect to 1 part by weight of the charge transport polymer. The poor solvent is used by 1 part by weight to 1000 parts by weight, preferably 10 parts by weight to 500 parts by weight with respect to 1 part by weight of the charge transport polymer.

(2) in a Case Where E is halogen

In a case where E is halogen, dihydric alcohols represented by HO—(Y—O)m—H are mixed with the monomer in substantially equivalent amounts in the presence of an organic and basic catalyst, such as pyridine or triethylamine, to perform polymerization. The organic and basic catalyst is used by 1 part by weight to 10 parts by weight, preferably 2 parts by weight to 5 parts by weight with respect to 1 part by weight of the charge transport monomer. As the solvent, it is effective to employ methylene chloride, tetrahydrofuran (THF), toluene, chlorobenzene or 1-chloronaphthalene. The solvent is used in a range from 1 part by weight to 100 parts by weight, preferably 2 parts by weight to 50 parts by weight with respect to 1 part by weight of the charge transport monomer. The reaction temperature may arbitrarily be set. After polymerization has been completed, a re-precipitation process is performed, and then a purifying process is performed.

In a case of dihydric alcohol, such as bisphenol, having a high acidity, a surface polymerization method may be employed. That is, dihydric alcohol is added to water, and then a base in the equivalent amount or larger is added thereto so as to be dissolved. Then, while vigorously stirring the solution, charge transport monomer solution in an amount equivalent to the dihydric alcohol is added so as to be polymerized. At this time, water is added by 1 part by weight to 1,000 parts by weight, preferably 2 parts by weight to 500 parts by weight with respect to 1 part by weight of the dihydric alcohol. As the solvent for dissolving the charge transport monomer, methylene chloride, dichloroethane, trichloroethane, toluene, chlorobenzene or 1-chloronaphthalene may effectively be employed. The reaction temperature may arbitrarily be set. In order to enhance the reaction, a phase transfer catalyst, such as ammonium salt or sulfonium salt, may effectively be employed. The phase transfer catalyst is used by 0.1 part by weight to 10 parts by weight, preferably 0.2 part by weight to 5 parts by weight with respect to 1 part by weight of the charge transport monomer.

(3) In a Case Where E is —O—$R_{15}$

In a case where E is —O—$R_{15}$, to the monomer dihydric alcohol represented by HO—(Y—O)m—H is added in an excessive quantity, in the presence of inorganic acid, such as sulfuric acid or phosphoric acid; titanium alkoxide; acetate or carbonate of a metal, such as calcium or cobalt; or oxide off zinc or lead, as a catalyst. The solution is heated so that ester interchange is performed for preparing the charge transport polymer. The dihydric alcohol is used by 2 equivalents to 100 equivalents, preferably 3 equivalents to 50 equivalents with respect to 1 equivalent of the charge transport monomer. The catalyst is used by 1/10,000 part by weight to 1 part by weight, preferably 1/1,000 part by weight to ½ part by weight with respect to 1 part by weight of the charge transport monomer. The reaction is performed at temperatures of 200° C. to 300° C. After the ester interchange from group —O—$R_{15}$ to —O— (Y—O)m—H is completed, polymerization due to removal of HO—(Y—O)m—H is enhanced by reducing the pressure to about 0.01 mmHg to about 100 mmHg, preferably 0.05 mmHg to 20 mmHg. A solvent, such as 1-chloronaphthalene, which is azeotropic with respect to HO— (Y—O)m—H, and which has a high boiling point, may be used such that reaction is allowed to take place while removing HO— (Y—O)m—H by azeotropy under atomospheric pressure.

The charge transport random copolymer represented by general formula (IV) can be prepared by mixing a derivative off carboxylic acid represented by E—OC—Z—CO—E and a monomer represented by general formula (V) or (VI) at a required ratio and then by using the method selected from the group consisting methods (1) to (3).

The charge transport polymer represented by general formula (III) can be prepared as follows:

In each of the foregoing cases, the reaction Ls allowed to take place while adding dihydric alcohol in an excessive quantity so that the compound copresented by any one of the following constitutional Formulas (VII) and (VIII) is prepared. Then, the compound, which is used as a charge transport monomer, is reacted with bivalent carboxylic acid or a bivalent carboxylic halide by a method similar to the method (2). As a result, the charge transport polymer can be obtained. If the polymerization degree p is too low, satisfactory film forming performance to form a strong film cannot be obtained. If the polymerization degree p is too high, solubility is too low to obtain satisfactory processability. Therefore, the polymerization degree p is made to be 5 to 5,000, preferably 10 to 8,000, and most preferably 15 to 1,000. The end of the polymer may be modified if required.

(VII)

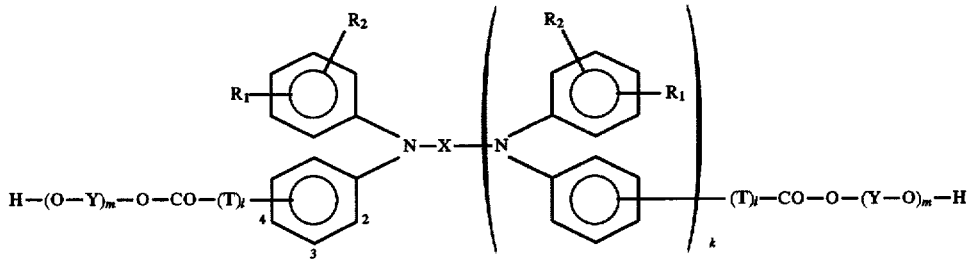

(VIII)

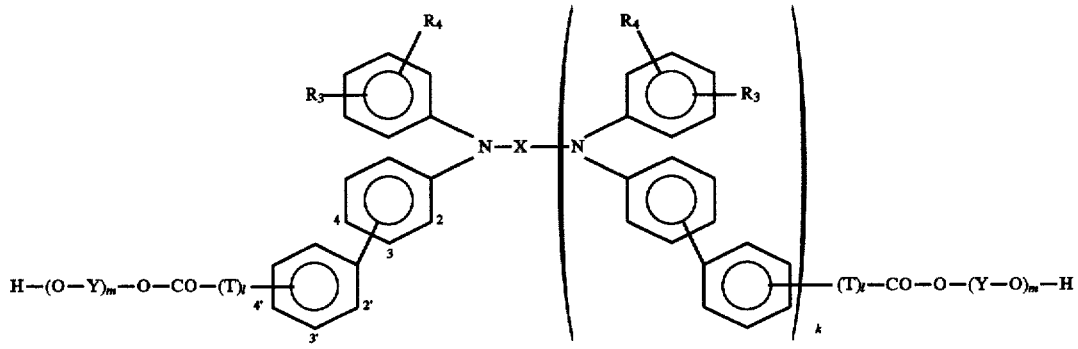

where $R_1$ to $R_4$, X, Y, m, k, l and T are as described above.

The structure and so forth of the electrophotographic photosensitive member according to the present invention will be next described.

Figure 2:
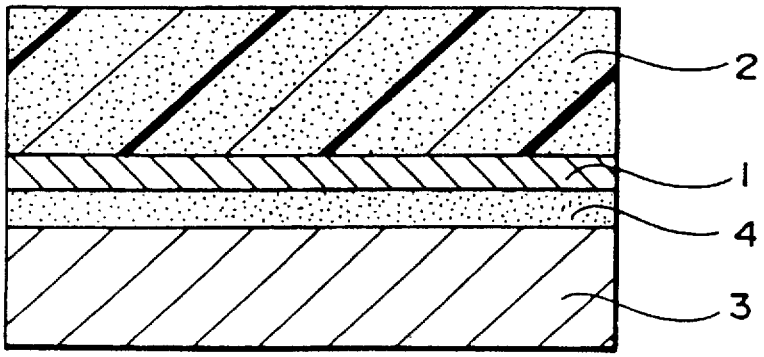
FIG. 2 is a schematic cross sectional view showing another example of the structure off the electrophotographic photosensitive member according to the present invention.
Figure 3:
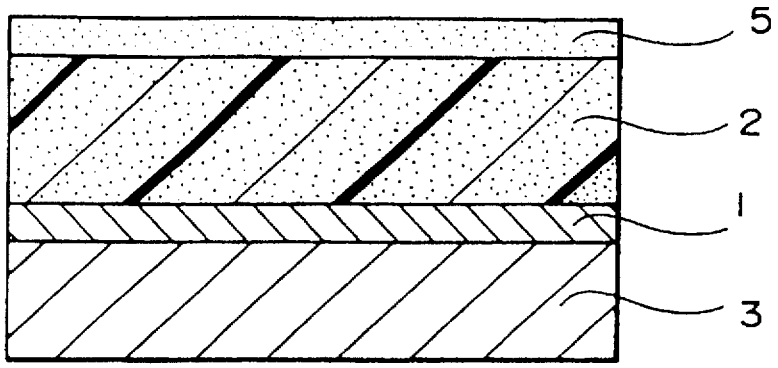
FIG. 3 is a schematic cross sectional view showing another example of the structure off the electrophotographic photosensitive member according to the present invention.
Figure 4:
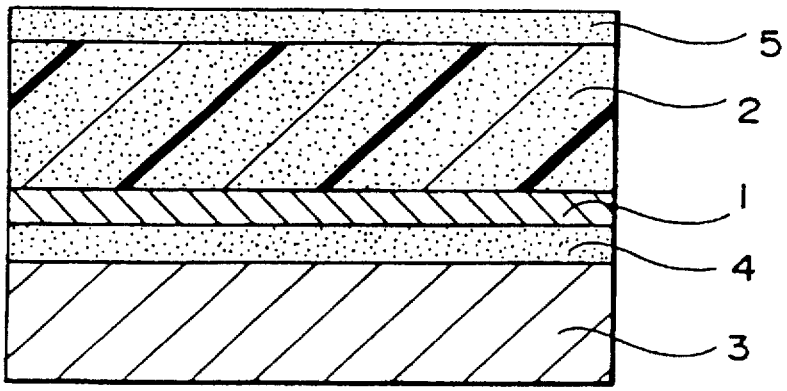
FIG. 4 is a schematic cross sectional view showing another example of the structure of the electrophotographic photosensitive member according to the present invention.
Figure 5:
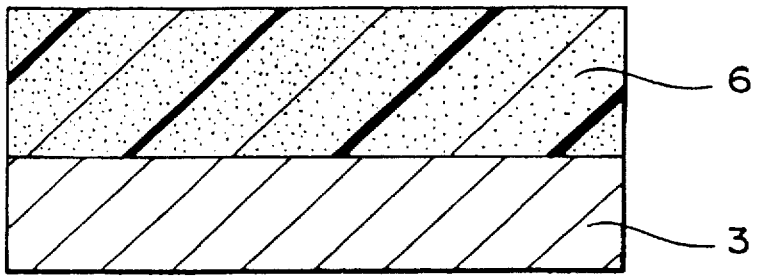
FIG. 5 is a schematic cross sectional view showing another example of the structure of the electrophotographic photosensitive member according to the present invention.
Figure 6:
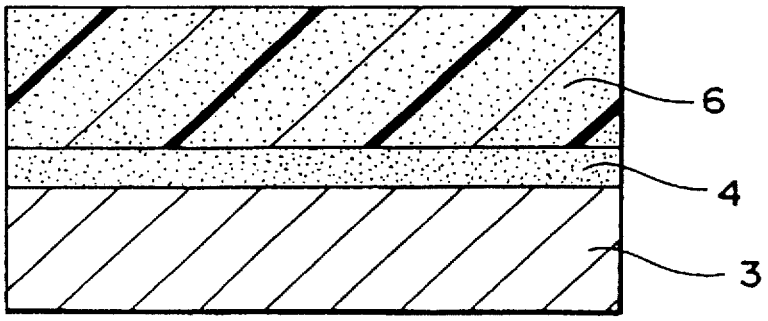
FIG. 6 is a schematic cross sectional view showing another example of the structure of the electrophotographic photosensitive member according to the present invention.

FIGS. 1 to 6 are schematic views showing respective cross sections of typical electrophotographic photosensitive members according to the present invention. Referring to FIG. 1, a charge generating layer 1 is formed on a conductive support member 3. A charge transport layer 2 is formed on the charge generating layer 1. Referring to FIG. 2, an undercoat layer 4 is formed on the conductive support member 3 in addition to the structure shown in FIG. 1. Referring to FIG. 2, a protective layer 5 is formed on the surface of the electrophotographic photosensitive member in addition to the structure shown in FIG. 1. Referring to FIG. 4, both off the undercoat layer 4 and the protective layer 5 are formed in the same configuration as shown in FIGS. 2 and 3 in addition to the structure shown in FIG. 1. FIGS. 5 and 6 respectively show an electrophotographic photosensitive member having a single-layer structure. Referring to FIG. 5, a single-layer photosensitive member 6 is formed on the conductive support member 8. Referring to FIG. 6, the undercoat layer 4 is formed below the single-layer photosensitive member 8 in addition to the structure shown in FIG. 5.

The conductive support member 8 may be made of a metal, such as aluminum, nickel, chromium or stainless steel, a plastic film having a thin film made of aluminum, titanium, nickel, chromium, stainless steel, gold, vanadium, tin oxide, indium oxide or ITO, or paper or a plastic film coated or impregnated with a conductivity producing agent. The conductive support member is Formed into an arbitrary shape, such as a drum shape, a sheet shape or a plate-like shape, in the present invention, however, the shape of the conductive support member is not limited to these shapes. If necessary, the surface of the conductive support member may be subjected to surface treatment which does not affect the image quality. For example, the surface may be subjected to an irregular reflection process, such as graining, an oxidizing process, a chemical process, or a coloring process.

The charge generating layer 1 is made of the foregoing pigment. The bonding resin for use in this layer may be selected from a variety of insulating resins. Any one of the following organic photoconductive polymers may be employed: poly-N-vinyl carbazole, polyvinyl anthracene, polyvinylpyrene and polysilane. Preferred bonding resins include insulating resins, such as polyvinyl butyral resin, polyarylate resin (a polycondensed material of bisphenol A and phthalic acid), polycarbonate resin, polyester resin, phenoxy resin, vinyl chloride/vinyl acetate copolymer, polyamide resin, acryl resin, polyacrylamide resin, polyvinylpyridine resin, cellulose resin, urethane resin, epoxy resin, casein, polyvinyl alcohol resin and polyvinylpyrrolidone resin, to which useful resins are not limited. Each of the foregoing binding resins may be employed solely or their mixture may be used.

It is preferable that the mixture ratio (the weight ratio) of the charge generating material containing the pigment to the binding resin be 10:1 to 1:10. The materials are dispersed by a conventional method, such as a ball mill method, an attritor dispersion method or a sandmill dispersion method.

When the dispersion process is performed, it is effective to make the size of particles to be 0.5 μm or smaller, preferably 0.8 μm or smaller, and most preferably 0.15 μm or smaller. Any one of the following usual organic solvents may be employed solely or in the form of a mixture as the solvent for use in the dispersion process: methanol, ethanol, n-propanol, n-butanol, benzyl alcohol, methyl cellosolve, ethyl cellosolve, acetone, methylethyl ketone, cyclohexanone, methyl acetate, n-butyl acetate, dioxane, tetrahydrofuran, methylenechloride, chloroform, chlorobenzene and toluene.

The charge transport layer 2 may be made from the above-mentioned charge transport polymer alone, or together with a known bonding resin or a hydrazone charge transport material, triarylamine charge transport material or a stilbene charge transport material. The binding resin may be selected from polycarbonate resin, polyester resin, methacrylate resin, acryl resin, polyvinyl chloride, polyvinylidene chloride, polystyrene resin, polyvinyl acetate resin, styrene/butadiene copolymer, vinylidene chloride/acrylonitrile copolymer, vinyl chloride/vinyl acetate copolymer, vinyl chloride/vinyl acetate/maleic arthydride copolymer, silicone resin, silicone/alkyd resin, phenol/formaldehyde resin, styrene/alkyd resin, poly-N-vinyl carbazole and polysilane in the present invention, however, useful binding resins are not limited to the foregoing resins. In a case where there is used polycarbonate resin which is included in the foregoing binding resins and is represented by the following constitutional formulas (IX) to (XIV), or polycarbonate resin prepared by copolymerizing two or more of the resins, a uniform film exhibiting excellent compatibility and satisfactory characteristics can be obtained. It is preferable that the mixture ratio (the weight ratio) of the charge transport polymer to the binding resin is 10:0 to 8:10. In a case where mixture with another charge transport material is performed, it is preferable that the mixture ratio be such that (the charge transport polymer+the binding resin):(the charge transport material)=10:0 to 10:8.

(IX)

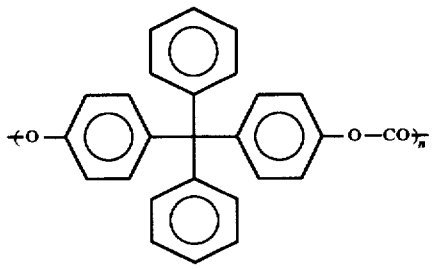

(X)

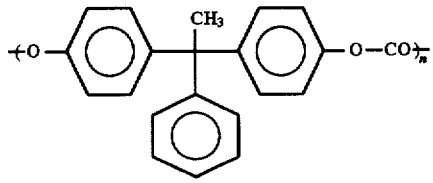

(XI)

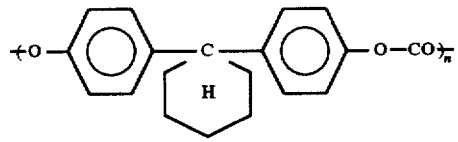

(XII)

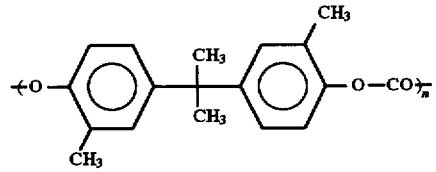

(XIII)

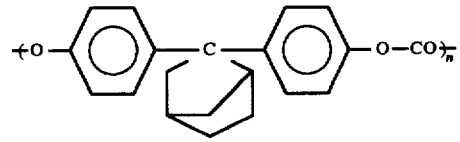

(XIV)

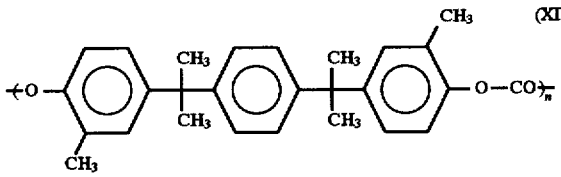

In the case where the single-layer photosensitive member 6 is employed, the above-mentioned pigment is added to the solution of the charge transport polymer, followed by dispersing so as to be applied. If necessary, an acceptor or an oxidation inhibitor may be mixed. The ratio of the charge generating material:the charge transport polymer is such that the charge generating material:charge transport polymer=1:99 to 40:60, preferably 5:95 to 30:70 (weight ratio). The thickness is 5 μm to 50 μm, preferably 10 μm to 40 μm. The single layer photosensitive member may be applied by a conventional method selected from a blade coating method, a Mayer bar coating method, a spray coating method, an immersion coating method, a bead coating method, an air knife coating method, a curtain coating method and the like. The solvent for use in the coating process may be a usual organic solvent selected from dioxane, tetrahydrofuran, methylenechloride, chloroform, chlorobenzene, toluene and the like, which may be used solely or in combination.

The illustrated undercoat layer prevents injection of a charge from the conductive support member from the photosensitive layer when the photosensitive layer having the laminated structure is electrically charged. Moreover, the undercoat layer serves as a bonding layer for integrally bonding and holding the photosensitive layer to the conductive support member. According to circumstances, the undercoat layer prevents reflection of light from the conductive support member.

The binding resin for forming the undercoat layer may be a known material selected from polyethylene resin, polypropylene resin, acryl resin, methacrylic resin, polyamide resin, vinyl chloride resin, vinyl acetate resin, phenol resin, polycarbonate resin, polyurethane resin, polyimide resin, vinylidene chloride resin, polyvinyl acetal resin, vinyl chloride/vinyl acetate copolymer, polyvinyl alcohol resin, water-soluble polyester resin, nitrocellulose, casein, gelatin, polyglutamic acid, starch, starch acetate, amino starch, polyacrylic acid, polyacrylamide, zirconium chelate compounds, titanium chelate compounds, titanium alkoxide compounds, organic titanium compounds, a silane coupling agent. The thickness of the undercoat layer is 0.01 μm to 10 μm, preferably 0.05 μm to 2 μm. The undercoat layer is formed by coating by a usual coating method selected from, for example, a blade coating method, a Mayer bar coating method, a spray coating method, an immersion coating method, a bead coating method, an air knife coating method, a curtain coating method.

The photosensitive member according to the present invention has a structure formed by combining the specific charge transport polymer and pigment serving as a specific charge generating material. Thus, improved sensitivity and stability can be obtained and deterioration in the actual sensitivity due to wear of the photosensitive layer and generation of defective image due to flaws can be prevented. Thus, the life of the image forming apparatus can be elongated.

EXAMPLES

Examples of the present invention will now be described. Hereinafter the word of "parts" indicates parts by weight unless otherwise specified.

The monomer for preparing the charge transport polymer can be prepared as follows:

Preparation Example 1

Preparation of N,N-bis[3-(2-ethoxycarbonylethyl)phenyl]-3, 4-xylidine (the structure of portion A is represented by 3 [Refer to Table 15] and the end is diethylester)

6 g of 3, 4-xylidine, 34 g of 3-iodo ethyl dihydrocinnamate, 19 g of potassium carbonate, 5 g of copper sulfate 5 hydrates and 20 ml of n-tridecane were charged into a 1000 ml flask, and then the solution was heated and reacted at 230° C. for 10 hours in a nitrogen gas flow. After the reaction was completed, the reactants were cooled to room temperature, and then dissolved in 500 ml of toluene. Then, insolubles were removed by filtration, and then the filtrate was purified with toluene by a silica gel column chromatography method. Thus, 20 g of oily N,N-bis[3-(2-ethoxycarbonylethyl)phenyl]-3, 4-xylidine was obtained.

Preparation Example 2

Preparation of N,N'-diphenyl-N,N'-bis[3-(2-ethoxycarbonylethyl)phenyl]-[1,1-biphenyl]-4,4'-diamine (the structure of portion A is represented by 6 and the end is diethylester)

10.77 g of N,N'-diphenylbenzidine, 23.0 g of 3-iodo ethyl dihydrocinnamate, 11.61 g of potassium carbonate, 1.0 g of copper sulfate 5 hydrates and 20 ml of n-tridecane were charged into a 100 ml flask, and then the solution was heated and reacted at 230° C. for 1 hour in a nitrogen gas flow. After the reaction was completed, the reactants were cooled to room temperature, and then dissolved in 50 ml of toluene. Then, insolubles were removed by filtration, and then the filtrate was purified with toluene by a silica gel column chromatography method. Thus, 19.6 g of oily N,N'-diphenyl-N,N'-bis[3-(2-ethoxycarbonylethyl)phenyl]-[1,1-biphenyl]-4,4'-diamine was obtained.

Preparation Example 3

Preparation of 3,3'-dimethyl-N,N'-bis(3,4-dimethylphenyl)-N,N'-bis[4-(2-methoxycarbonylethyl)phenyl]-[1,1'-biphenyl]-4,4'-diamine (the structure of portion A is represented by 19 and the end is dimethyl ester)

45 g of N-(3,4-dimethylphenyl)-N-[4-(2-methoxycarbonylethyl)phenyl]amine, 30 g of 4,4'-diiodo-3, 3'-dimethylbiphenyl, 27 g of potassium carbonate, 5 g of copper sulfate 5 hydrates and 20 ml of n-tridecane were charged into a 1000 ml flask, and then the solution was heated and reacted at 230° C. for 5 hour in a nitrogen gas flow. After the reaction was completed, the reactants were cooled to room temperature, and then dissolved in 200 ml of toluene. Then, insolubles were removed by filtration, and then the filtrate was purified with toluene by a silica gel column chromatography method. Then, recrystallization was performed from a mixture solvent of ethyl acetate and ethanol so that 38 g of 3,3'-dimethyl-N,N'-bis(3,4-dimethylphenyl)-N,N'-bis[4-(2-methoxycarbonylethyl) phenyl]-[1,1-biphenyl]-4,4'-diamine in the form of a light yellow powder was obtained. (m.p.=162.5°–164° C.)

Preparation Example 4

Preparation of N,N'-diphenyl-N,N'-bis[4-(4-ethoxycarbonylethylphenyl)-phenyl]-[1,1-biphenyl]-4,4'-diamine (the structure of portion A is represented by 48 and the end is diethylester)

10.0 g of N,N'-diphenylbenzidine, 24.0 g of 4-ethoxycarbonylethyl-4'-iodobiphenyl, 11 g of potassium carbonate, 1.0 g of copper sulfate 5 hydrates and 30 ml of n-tridecane were charged into a 200 ml flask, and then the solution was heated and reacted at 230° C. for 1 hour in a nitrogen gas flow. After the reaction was completed, the reactants were cooled to room temperature, and then dissolved in 10 ml of toluene. Then, insolubles were removed by filtration, and then the filtrate was purified with toluene by a silica gel column chromatography method. Thus, 16.6 g of oily N,N'-diphenyl-N,N'-bis[4-(4-ethoxycarbonylphenyl)-phenyl]-[1,1'-biphenyl]-4,4'-diamine was obtained.

Preparation Example 5

Preparation of Charge transport Polymer (CTP-6)

8.0 g of N,N-bis[3-(2-ethoxycarbonylethyl)phenyl]-3,4-xylidine, 20.0 g of ethylene glycol and 0.1 g of tetrabutoxytitane were charged into a 200 ml flask, and then the solution was refluxed with heat for 3 hours in a nitrogen gas flow. After consumption of N,N-bis[3-(2-ethoxycarbonylethyl)phenyl]-3,4-xylidine was confirmed, the pressure was lowered to 0.5 mmHg. Thus, while distilling ethylene glycol off, the solution was heated to 230° C. and the reaction was allowed to be continued for 3 hours. Then, the reactants were cooled to room temperature, and then dissolved in 100 ml of THE. Then, insolubles were removed by filtration, and then the filtrate was dropped into 1000 ml of water which was being stirred so that the polymer was precipitated. After the precipitation was sufficiently washed with water, and then it was dried so that 7.2 g of polymer was obtained. The molecular weight was measured by GPC, thus resulting in Mw=$1.05\times10^5$ (in terms of styrene)(the polymerization degree p=about 230).

Preparation Example 6

Preparation of Charge transport Polymer (CTP-1)

10 g of N,N'-diphenyl-N,N'-bis[3-(2-ethoxycarbonylethyl)phenyl]-[1,1'-biphenyl]-4,4'-diamine, 20 g of ethyleneglycol and 0.1 g of tetrabutoxytitane were charged into a 200 ml flask, and then the solution was refluxed with heat for 3 hours in a nitrogen gas flow. After consumption of N,N'-diphenyl-N,N'-bis[3-(2-ethoxycarbonylethyl)phenyl]-[1,1'-biphenyl]-4,4'-diamine was confirmed, the pressure was lowered to 0.5 mmHg. Thus, while distilling ethylene glycol off, the solution was heated to 230° C. and the reaction was allowed to be continued for 3 hours. Then, the reactants were cooled to room temperature, and then dissolved in 100 ml of methylene chloride. Then, insolubles were removed by filtration, and then the filtrate was dropped into 1000 ml of acetone which was being stirred so that the polymer was precipitated. The obtained polymer was dissolved in 100 ml of THF, and then the filtrate was dropped in 1000 ml of water which was being stirred so that polymer was precipitated. After the precipitation was sufficiently washed with water, and then it was dried so that 8.4 g of polymer was obtained. The molecular weight was measured by GPC, thus resulting in Mw=$1.10\times10^5$ (in terms of styrene)(the polymerization degree p=about 165).

Preparation Example 7

Preparation of Charge transport Polymer (CTP-23)

10 g of N,N'-diphenyl-N,N'-bis[3-(2-ethoxycarbonylethyl)phenyl]-[1,1-biphenyl]-4,4-diamine, 20 g of ethyleneglycol and 0.1 g of tetrabutoxytitane were charged into a 500 ml flask, and then the solution was refluxed with heat for 3 hours in a nitrogen gas flow. After consumption off N,N'-diphenyl-N,N'-bis[3-(2-ethoxycarbonylethyl)phenyl]-[1,1'-biphenyl]-4,4'-diamine was confirmed, the pressure was lowered to 0.5 mmHg, to distill ethyleneglycol off. Then, the reactants were cooled to room temperature, and then dissolved in 200 ml of methylene chloride. Into the resultant, solution in which 3.0 g of dichloride isophthalate was dissolved in 100 ml of methylene chloride was dropped. Then, 6.1 g of triethylamine was added thereinto, and the solution was refluxed with heat for 30 minutes. 3 ml of methanol was added, and the solution was refluxed with heat for 30 minutes. Insolubles were removed by filtration, and subsequently the filtrate was dropped into 1000 ml of ethanol which was being stirred so that polymer was precipitated. The precipitation was sufficiently washed with ethanol, and then it was dried so that 6.1 g of polymer was obtained. The molecular weight was measured by GPC, thus resulting in Mw=$1.70\times10^4$ (in terms of styrene)(the polymerization degree p=about 20).

Preparation Example 8

Preparation of Charge transport Polymer (CTP-3)

10 g of N,N'-diphenyl-N,N'-bis[3-(2-ethoxycarbonylethyl)phenyl]-[1,1-biphenyl]-4,4-diamine, 20 g of 1,4-cyclohexanediol (cis/trans-mixture) and 0.1 g of tetrabutoxytitane were charged into a 500 ml flask, and then the solution was refluxed with heat for 2 hours in a nitrogen gas flow. After consumption of N,N'-diphenyl-N,N'-bis[3-(2-ethoxycarbonylethyl)phenyl]-[1,1'-biphenyl]-4,4'-diamine was confirmed, the pressure was towered to 0.5 mmHg. While distilling 1,4-cyclohexanediol off, the solution was heated to 230° C., and then the reaction was allowed to be continued for 5 hours. Then, the reactants were cooled to room temperature, and subsequently dissolved in 100 ml of methylene chloride. Then, insolubles were removed by filtration, and then the filtrate was dropped into 1000 ml of ethanol which was being stirred so that polymer was precipitated. The precipitation was sufficiently washed with ethanol and water, and then it was dried so that 8.6 g of polymer was obtained. The molecular weight was measured by GPC, thus resulting in Mw=$2.80\times10^4$ (in terms of styrene)(the polymerization degree p=about 35).

Preparation Example 9

Preparation of Charge transport Polymer (CTP-7)

20 g of 3,3'-dimethyl-N,N'-bis(3,4-dimethylphenyl)-N,N'-bis[4-(2-methoxycarbonylethyl)phenyl]-[1,1-biphenyl]-4,4'-diamine, 40 g of ethylene glycol and 0.1 g of tetrabutoxytitane were charged into a 500 ml flask, and then the solution was refluxed with heat for 3 hours in a nitrogen gas flow. After consumption of 3,3'-dimethyl-N,N'-bis(3,4-dimethylphenyl)-N,N'-bis[4-(2-methoxycarbonylethyl)phenyl]-[1,1-biphenyl]-4,4'-diamine was confirmed, the pressure was lowered to 0.5 mmHg. While distilling ethylene glycol off, the solution was heated to 230° C., and then the reaction was allowed to be continued for 3 hours. Then, the reactants were cooled to room temperature, and then dissolved in 200 mL of methylene chloride. Subsequently, insolubles were removed by filtration, and then the filtrate was dropped into 1500 ml of ethanol which was being stirred so that polymer was precipitated. The obtained precipitation was filtered, and sufficiently washed with ethanol, and then it was dried so that 19.2 g of polymer was obtained. The molecular weight was measured by GPC, thus resulting in Mw=$1.10\times10^5$ (in terms of styrene)(the polymerization degree p=about 165).

Preparation Example 10

Preparation of Charge transport Polymer (CTP-32)

15 g of 3,3'-dimethyl-N,N'-bis(3,4-dimethylphenyl)-N,N'-bis[4-(2-methoxycarbonylethyl)phenyl]-[1,1'-biphenyl]-4,4'-diamine, 3.0 g of dimethyl sebacate, 30 g off ethylene glycol and 0.1 g of tetrabutoxytitane were charged into a 200 ml flask, and then the solution was refluxed with heat for 3 hours in a nitrogen gas flow. After consumption off 3,3'-dimethyl-N,N'-bis(3,4-dimethylphenyl)-N,N'-bis[4-(2-methoxycarbonyl)phenyl]-[1,1'-biphenyl]-4,4'-diamine was confirmed, the pressure was lowered to 0.5 mmHg. While distilling ethylene glycol off, the solution was heated to 230° C., and then the reaction was allowed to be continued for 3 hours. Then, the reactants were cooled to room temperature, and then dissolved in 100 ml of methylene chloride. Subsequently, insolubles were removed by filtration, and then the solution was dropped into 1000 ml of acetone which was being stirred so that polymer was precipitated. Then, the precipitation was dried so that 16.3 g of polymer was obtained. The molecular weight was measured by GPC, thus resulting in Mw=$8.01\times10^4$ (in terms of styrene)(the polymerization degree p=about 90, and r=about 60).

Preparation Example 11

Preparation of Azo-21

10 g of 2,7-diaminofluorenone was added to mixture solution of 90 ml of concentrated hydrochloric acid and 90 ml of water, and then dissolved at about 60° C. The solution was cooled to about 0° C. Solution in which 6.9 g of sodium nitrite was dissolved in 11 ml of water, was slowly dropped into the cooled solution at 0° C. to 5° C. Then, the solution was stirred at the foregoing temperature for about 30 minutes, after which the insolubles were removed by filtration. The filtrate was dropped into 75 ml of 42% hydroborofluoride, and then precipitated crystal was filtered, washed with water and then dried so that 13.5 g of tetrazonium salt was obtained. 5 g of the tetrazonium salt and 7.3 g of 2-hydroxy-3-anilide naphthoate were dissolved in 1000 ml of N,N-dimethylformamide cooled to about 0° C. Then, into the solution was slowly dropped solution consisting of 10.3 g of sodium acetate and 150 ml of water at 4° C. to 80° C. After the dropping operation was completed, the solution was stirred at room temperature for 3 hours. Generated sediments were filtered, and then sufficiently washed with water, N,N-dimethylformamide and acetone, and then dried so that 7.3 g of azo pigment (Azo-21) was obtained.

Example 1

Solution consisting of 10 parts of a zirconium compound (ORCATICS ZC540, trade name of Mastumoto Chemical Industry Co., Ltd.), 1 part of a silane compound (A1110, trade name of Nippon Unicar Co., Ltd.), 40 parts of isopropanol and 20 parts of butanol was applied to the outer surface of an aluminum pipe by the immersion coating method. Then, the aluminum pipe was heated at 150° C. For 10 minutes so as to be dried. Thus, an undercoat layer having a thickness of 0.1 μm was formed. 10 parts of azo pigment (Azo-21) obtained in Preparation Example 11 were mixed with 1 part of polyvinylbutyral resin (S-LEG BM-S, trade name of Sekisui Chemical Co., Ltd.) and 200 parts of 1-butanol. Then, the mixed solution was dispersed in a sand mill including glass beads for one hour. The obtained solution for coating was applied to the upper surface of the undercoat layer by the immersion coating method. Then, the applied coating was dried with heat at 100° C. for 10 minutes so that a charge generating layer having a thickness of 0.4 μm was formed. 3 parts of the charge transport polyester (Exemplified Compound CTP-1) obtained in Preparation Example 6 were dissolved in mixed solution composed of 15 parts of monochlorobenzene and 15 parts of tetrahydrofuran. Then, the obtained solution was applied to the upper surface of the charge generating layer by the immersion coating method, followed by drying the applied coating with heat of 115° C. for 1 hour so that a charge transport layer having a thickness of 18 μm was formed.

The thus-obtained photosensitive member was mounted on a copying machine (FX-2700, trade name of Fuji Xerox Co., Ltd.). Using the machine, images were formed and the quality of the images was evaluated. Then, the printing operation was repeated by 50,000 times to evaluate the quality of the formed images. Moreover, the amount of abrasion of the top surface of the photosensitive member was measured. Results are shown in Table 25 below.

Examples 2 to 24

Respective photosensitive members were manufactured in the same manner as in Example 1 except that the combination of the charge transport polyester and the bisazo pigment was used as shown in Table 25, and then evaluation was performed in the same manner. Results are shown in Table 25 below.

Comparative Example 1

A photosensitive member was manufactured in the same manner as in Example 1 except that a charge transport layer was used which was formed such that two parts of the following benzidine compound (Bz) and 3 parts of polycarbonate resin (viscosity average molecular weight: $Mv=4.4\times10^4$) composed of repeated structure units represented by the foregoing constitutional formula (XI) were dissolved in a mixed solvent including 15 parts of monochlorobenzene and 15 parts of tetrahydrofuran, and then the solution was applied and dried. Evaluation was performed in the same manner. Results are shown in Table 25 below.

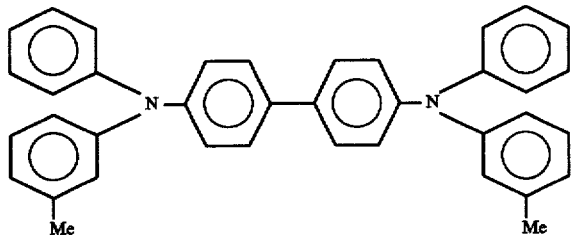

Comparative Example 2

A photosensitive member was manufactured in the same manner as in Comparative Example 1 except that a charge transport layer was used which was composed of 3 parts of the following hydrazone compound (Hy) in place of the benzidine compound (Bz) according to Comparative Example 1 and 3 parts of polycarbonate resin (viscosity average molecular weight: $Mv=4.8\times10^4$) composed of repeated structure units represented by the foregoing constitutional formula (XII). Evaluation was performed in the same manner. Results are shown in Table 25 below.

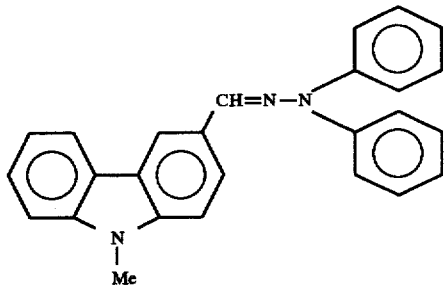

Example 25

A photosensitive member was manufactured in the same manner as in Comparative Example 1 except that a protecting layer was formed on the charge transport layer according to Comparative Example 1, the protective layer being a mixture consisting of 2 parts of illustrated compound CTP-7 and 1 part of polycarbonate resin (viscosity average molecular weight: $Mv=4.0\times10^4$) composed of the repeated structure units represented by the foregoing constitutional formula (XII). Evaluation was performed in the same manner. Results are shown in Table 25 below.

Example 26

A photosensitive member was manufactured in the same manner as in Comparative Example 1 except that a protecting layer was formed on the charge transport layer according to Comparative Example 2, the protective layer being a mixture consisting of 2 parts of exemplified compound CTP-8 and 1 part of polycarbonate resin (viscosity average molecular weight: $Mv=4.0\times10^4$) composed of the repeated structure units represented by the foregoing constitutional formula (XII). Evaluation was performed in the same manner. Results are shown in Table 25 below.

TABLE 25

| | CHARGE TRANSPORT POLYESTER | CGM | IMAGE QUALITY AFTER 50,000 SHEETS HAVE BEEN PRINTED | AMOUNT OF ABRASION (μM) |
|---|---|---|---|---|
| EXAMPLE 1 | CTP-1 | Azo-21 | NO DEFECT | 0.8 |
| EXAMPLE 2 | CTP-1 | Azo-1 | NO DEFECT | 0.7 |
| EXAMPLE 3 | CTP-1 | Azo-9 | NO DEFECT | 0.8 |
| EXAMPLE 4 | CTP-1 | Azo-10 | NO DEFECT | 0.9 |
| EXAMPLE 5 | CTP-6 | Azo-9 | NO DEFECT | 1.6 |
| EXAMPLE 6 | CTP-3 | Azo-10 | NO DEFECT | 1.0 |
| EXAMPLE 7 | CTP-5 | Azo-14 | NO DEFECT | 0.9 |
| EXAMPLE 8 | CTP-8 | Azo-14 | NO DEFECT | 1.2 |
| EXAMPLE 9 | CTP-8 | Azo-15 | NO DEFECT | 1.3 |
| EXAMPLE 10 | CTP-8 | Azo-16 | NO DEFECT | 1.3 |
| EXAMPLE 11 | CTP-23 | Azo-16 | NO DEFECT | 1.7 |
| EXAMPLE 12 | CTP-13 | Azo-21 | NO DEFECT | 2.1 |
| EXAMPLE 13 | CTP-14 | Azo-34 | NO DEFECT | 1.2 |
| EXAMPLE 14 | CTP-15 | Azo-41 | NO DEFECT | 1.2 |
| EXAMPLE 15 | CTP-7 | Azo-1 | NO DEFECT | 1.3 |
| EXAMPLE 16 | CTP-7 | Azo-9 | NO DEFECT | 1.6 |
| EXAMPLE 17 | CTP-7 | Azo-10 | NO DEFECT | 1.5 |
| EXAMPLE 18 | CTP-7 | Azo-52 | NO DEFECT | 1.6 |
| EXAMPLE 19 | CTP-28 | Azo-25 | NO DEFECT | 1.3 |
| EXAMPLE 20 | CTP-32 | Azo-40 | NO DEFECT | 1.0 |
| EXAMPLE 21 | CTP-33 | Azo-21 | NO DEFECT | 0.7 |
| EXAMPLE 22 | CTP-33 | Azo-34 | NO DEFECT | 0.8 |
| EXAMPLE 23 | CTP-33 | Azo-35 | NO DEFECT | 0.8 |
| EXAMPLE 24 | CTP-45 | Azo-59 | NO DEFECT | 1.7 |
| EXAMPLE 25 | CTP-7 + XII | Azo-35 | NO DEFECT | 1.0 |
| EXAMPLE 26 | CTP-8 + XII | Azo-59 | NO DEFECT | 1.4 |
| COMPARATIVE EXAMPLE 1A | BENZIDINE + XI | Azo-21 | ABRASION FLAWS WERE FOUND OVER THE ENTIRE SURFACE AND FOG TOOK PLACE | 4.6 |
| COMPARATIVE EXAMPLE 2A | HYDRAZONE + XII | Azo-21 | ABRASION FLAWS WERE FOUND OVER THE ENTIRE SURFACE AND FOG TOOK PLACE | 5.8 |

CGM: charge generating material

Preparation Example 12

Preparing Dibromoanthoanthrone or the like into Pigment 20 g of Dibromoanthoanthrone (MONOLIGHT RED 2Y) manufactured by ICI was, together with 40 g of sodium chloride, pulverized for 24 hours by using a planetary ball mill (inner diameter of an agate pot was 100 mm, the pot including 44 agate balls each having a diameter of 20 mm and 3 agate balls each having a diameter of 25 mm). Then, the pulverized dibromoanthoanthrone was sufficiently washed with distilled water and then dried so that 19.2 g of dibromoanthoanthrone pigment was obtained, which was referred to as CG-1. Dibrombenzanthrone, dichloroisoviolanthoene and dichloroindanthrone prepared into pigments in the same manner were referred to as CG2, CG3 and CG4, respectively.

Example 1A

Solution consisting of 10 parts of a zirconium compound (ORGATICS ZC540, trade name of Matumoto), 1 part of a silane compound (A1110, trade name of Nippon Unicar Co., Ltd.), 40 parts of isopropanol and 20 parts of butanol was applied to the outer surface of an aluminum pipe by the immersion coating method. Then, the aluminum pipe was heated at 150° C. for 10 minutes so as to be dried. Thus, an undercoat layer having a thickness of 0.1 μm was formed. Then, 10 parts of the dibromoanthoanthrone pigment obtained in Preparation Example 12 were mixed with 1 part of polyvinylbutyral resin (S-LEG BM-S, trade name of Sekisui Chemical Co., Ltd.) and 200 parts of 1-butanol. The mixture was then dispersed in a sand mill including glass beads for one hour. The obtained solution for coating was applied to the upper surface of the undercoat layer by the immersion coating method. Then, the applied coating was dried with heat at 100° C. for 10 minutes so that a charge generating layer having a thickness of 0.4 μm was formed. 3 parts of the charge transport polyester (Exemplified Compound CTP-1) obtained in Preparation Example 6 were dissolved in mixed solution composed of 15 parts of monochlorobenzene and 15 parts of tetrahydrofuran. Then, the obtained solution was applied to the upper surface of the charge generating layer by the immersion coating method, and then the applied coating was dried with heat of 115° C. so that a charge transport layer having a thickness of 18 um was formed.

The thus-obtained photosensitive member was mounted on a copying machine (FX-2700, trade name of Fuji Xerox Co., Ltd.). Using the machine, images were formed and the quality of the images was evaluated. Subsequently, the printing operation was repeated by 50,000 times to evaluate the quality of the formed images. Moreover, the amount of abrasion of the top surface of the photosensitive member was measured. Results are shown in Table 26 below.

Examples 2A to 22A

Respective photosensitive members were manufactured in the same manner as in Example 1A except that the combination of the charge transport polyester and the condensation and polycyclic aromatic pigment was used as shown in Table 26. Evaluation was performed in the same manner. Results are shown in Table 26 below.

Comparative Example 1A

A photosensitive member was manufactured in the same manner as in Example 1A except that a charge transport layer was used which was formed such that two parts of the foregoing benzidine compound (Bz) and 3 parts of polycarbonate resin (viscosity average molecular weight: Mv=4.4×$10^4$) composed of repeated structure units represented by the foregoing constitutional formula (XI) were dissolved in a mixed solvent including 15 parts of monochlorobenzene and 15 parts of tetrahydrofuran, and then the solution was applied and dried. Evaluation was performed in the same manner. Results are shown in Table 26 below.

Comparative Example 2A

A photosensitive member was manufactured in the same manner as in Comparative Example 1A except that a charge transport layer was used which was composed of 3 parts of a hydrazone compound (Hy) in place of the benzidine compound (Bz) according to Comparative Example 1A and 3 parts of polycarbonate resin (viscosity average molecular weight: Mv=4.8×$10^4$) composed of repeated structure units represented by the foregoing constitutional formula (XII). Evaluation was performed in the same manner. Results are shown in Table 26 below.

Example 23A

A photosensitive member was manufactured in the same manner as in Comparative Example 1 except that a protecting layer was formed on the charge transport layer according to Comparative Example 1A, the protective layer being a mixture consisting of 2 parts of exemplified compound CTP-7 and 1 part of polycarbonate resin (viscosity average molecular weight: Mv=4.0×$10^4$) composed of the repeated structure units represented by the foregoing constitutional formula (XII). Evaluation was performed in the same manner. Results are shown in Table 26 below.

Example 24A

A photosensitive member was manufactured in the same manner as in Comparative Example 1A except that a protecting layer was formed on the charge transport layer according to Comparative Example 2A, the protective layer being a mixture consisting of 2 parts of exemplified compound CTP-8 and 1 part of polycarbonate resin (viscosity average molecular weight: Mv=4.0×$10^4$) composed of the repeated structure units represented by the foregoing constitutional formula (XII). Evaluation was performed in the same manner. Results are shown in Table 26 below.

TABLE 26

| | CHARGE TRANSPORT POLYESTER | CGM | IMAGE QUALITY AFTER 50,000 SHEETS HAVE BEEN PRINTED | AMOUNT OF ABRASION (μM) |
|---|---|---|---|---|
| EXAMPLE 1A | CTP-1 | CG-1 | NO DEFECT | 0.8 |
| EXAMPLE 2A | CTP-1 | CG-2 | SLIGHT FOG TOOK PLACE | 0.7 |
| EXAMPLE 3A | CTP-1 | CG-3 | SLIGHT FOG TOOK PLACE | 0.8 |
| EXAMPLE 4A | CTP-1 | CG-4 | SLIGHT FOG TOOK PLACE | 0.9 |
| EXAMPLE 5A | CTP-6 | CG-1 | NO DEFECT | 1.6 |
| EXAMPLE 6A | CTP-3 | CG-1 | NO DEFECT | 1.0 |
| EXAMPLE 7A | CTP-8 | CG-1 | NO DEFECT | 1.2 |
| EXAMPLE 8A | CTP-8 | CG-2 | NO DEFECT | 1.3 |
| EXAMPLE 9A | CTP-8 | CG-4 | NO DEFECT | 1.3 |
| EXAMPLE 10A | CTP-23 | CG-1 | NO DEFECT | 1.7 |
| EXAMPLE 11A | CTP-14 | CG-2 | SLIGHT FOG TOOK PLACE | 1.2 |
| EXAMPLE 12A | CTP-15 | CG-3 | SLIGHT FOG TOOK PLACE | 1.2 |
| EXAMPLE 13A | CTP-7 | CG-1 | NO DEFECT | 1.3 |
| EXAMPLE 14A | CTP-7 | CG-2 | NO DEFECT | 1.6 |
| EXAMPLE 15A | CTP-7 | CG-3 | NO DEFECT | 1.5 |
| EXAMPLE 16A | CTP-7 | CG-4 | NO DEFECT | 1.6 |
| EXAMPLE 17A | CTP-28 | CG-2 | SLIGHT FOG TOOK PLACE | 1.3 |
| EXAMPLE 18A | CTP-32 | CG-3 | SLIGHT FOG TOOK PLACE | 1.0 |
| EXAMPLE 19A | CTP-33 | CG-1 | NO DEFECT | 0.7 |
| EXAMPLE 20A | CTP-33 | CG-2 | NO DEFECT | 0.8 |
| EXAMPLE 21A | CTP-33 | CG-3 | NO DEFECT | 0.8 |
| EXAMPLE 22A | CTP-45 | CG-1 | NO DEFECT | 1.7 |
| EXAMPLE 23A | CTP-7 + XII | CG-1 | NO DEFECT | 1.0 |
| EXAMPLE 24A | CTP-8 + XII | CG-1 | NO DEFECT | 1.4 |
| COMPARATIVE EXAMPLE 1A | BENZIDINE + XI | CG-1 | ABRASION FLAWS WERE FOUND OVER THE ENTIRE SURFACE AND FOG TOOK PLACE | 4.6 |
| COMPARATIVE EXAMPLE 2A | HYDRAZONE + XII | CG-1 | ABRASION FLAWS WERE FOUND OVER THE ENTIRE SURFACE AND FOG TOOK PLACE | 5.8 |

Preparation Example 13 (Preparation of P-1)

A method disclosed in JP-A-3-24059 was employed to prepare bisbenzimidazole perylene pigment (a mixture of cis and trans: P-1), and then sublimated and purified. 5 g of sublimated and purified bisbenzimidazole perylene pigment was, together with 10 g of sodium chloride, pulverized for 27 hours by using a planetary ball mill (inner diameter of an agate pot was 100 mm, the pot including 44 agate balls each having a diameter of 20 mm and 3 agate balls each having a diameter of 25 mm). Then, the pulverized pigment was sufficiently washed with distilled water and then dried so that 4.8 g of bisbenzimidazole perylene pigment was obtained.

Example 1B

Solution consisting of 10 parts of a zirconium compound (ORCATICS ZC540, trade name of Matsumoto Chemical Industry Co., Ltd.), 1 part of a silane compound (A1110, trade name of Nippon Unicar, Co., Ltd.), 40 parts of isopropanol and 20 parts of butanol was applied to the outer surface of an aluminum pipe by the immersion coating method. Then, the aluminum pipe was heated at 150° C. for 10 minutes so as to be dried. Thus, an undercoat layer having a thickness of 0.1 μm was formed. Then, 10 parts of the perylene pigment P-1 obtained in Preparation Example 13 were mixed with 1 part of polyvinylbutyral resin (S-LEC BM-S, trade name of Sekisui Chemical Co., Ltd.) and 200 parts of 1-butanol. Then, the mixed solution was dispersed in a sand mill including glass beads for one hour. The obtained solution for coating was applied to the upper surface of the undercoat layer by the immersion coating method. The applied coating was dried with heat at 100° C. for 10 minutes so that a charge generating layer having a thickness of 0.4 μm was formed. Subsequently, 3 parts of the charge transport polyester (Exemplified Compound CTP-1) obtained in Preparation Example 6 were dissolved in mixed solution composed of 15 parts of monochlorobenzene and 15 parts of tetrahydrofuran. Then, the obtained solution was applied to the upper surface of the charge generating layer by the immersion coating method, and then the applied coating was dried with heat of 115° C. so that a charge transport layer having a thickness of 18 μm was formed.

The thus-obtained photosensitive member was mounted on a copying machine (FX-2700, trade name of Fuji Xerox Co., Ltd.). Using the machine, images were formed and the quality of the images was evaluated. Then, the printing operation was repeated by 50,000 times to evaluate the quality of the formed images. Moreover, the amount of abrasion of the top surface of the photosensitive member was measured. Results are shown in Table 27 below.

Examples 2B to 24B

Respective photosensitive members were manufactured in the same manner as in Example 1B except that the combination of the charge transport polyester and the perylene pigment was used as shown in Table 27, and then evaluation was performed in the same manner. Results are shown in Table 27 below.

Comparative Example 1B

A photosensitive member was manufactured in the same manner as in Example 1B except that a charge transport layer was used which was formed such that 2 parts of the foregoing benzidine compound (Bz) and 3 parts of polycarbonate resin (viscosity average molecular weight: $Mv=4.4\times10^4$) composed of repeated structure units represented by the foregoing constitutional formula (XI) were dissolved in a mixed solvent including 15 parts of monochlorobenzene and 15 parts of tetrahydrofuran, and then the solution was applied and dried. Evaluation was performed in the same manner. Results are shown in Table 27 below.

Comparative Example 2B

A photosensitive member was manufactured in the same manner as in Comparative Example 1B except that a charge transport layer was used which was composed of 3 parts of the foregoing hydrazone compound (Hy) in place of the benzidine compound (Bz) according to Comparative Example 1B and 3 parts of polycarbonate resin (viscosity average molecular weight: $Mv=4.8\times10^4$) composed of repeated structure units represented by the foregoing constitutional formula (XII). Evaluation was performed in the same manner. Results are shown in Table 27 below.

Example 25B

A photosensitive member was manufactured in the same manner as in Comparative Example 1B except that a protecting layer was formed on the charge transport layer according to Comparative Example 1B, the protective layer being a mixture consisting of 2 parts of exemplified compound CTP-7 and 1 part of polycarbonate resin (viscosity average molecular weight: $Mv=4.0\times10^4$) composed of the repeated structure units represented by the foregoing constitutional formula (XII). Evaluation was performed in the same manner. Results are shown in Table 27 below.

Example 26B

A photosensitive member was manufactured in the same manner as in Comparative Example 2B except that a protecting layer was formed on the charge transport layer according to Comparative Example 2B, the protective layer being a mixture consisting of 2 parts of exemplified compound CTP-8 and 1 part of polycarbonate resin (viscosity average molecular weight: $Mv=4.0\times10^4$) composed of the repeated structure units represented by the foregoing constitutional formula (XII). Evaluation was performed in the same manner. Results are shown in Table 27 below.

TABLE 27

| | CHARGE TRANSPORT POLYESTER | CGM | IMAGE QUALITY AFTER 50,000 SHEETS HAVE BEEN PRINTED | AMOUNT OF ABRASION (μM) |
|---|---|---|---|---|
| EXAMPLE 1B | CTP-1 | P-1 | NO DEFECT | 0.8 |
| EXAMPLE 2B | CTP-1 | P-15 | NO DEFECT | 0.7 |
| EXAMPLE 3B | CTP-1 | P-17 | NO DEFECT | 0.8 |
| EXAMPLE 4B | CTP-1 | P-23 | NO DEFECT | 0.9 |
| EXAMPLE 5B | CTP-6 | P-3 | NO DEFECT | 1.6 |
| EXAMPLE 6B | CTP-3 | P-10 | NO DEFECT | 1.0 |
| EXAMPLE 7B | CTP-5 | P-35 | NO DEFECT | 0.9 |
| EXAMPLE 8B | CTP-8 | P-1 | NO DEFECT | 1.2 |
| EXAMPLE 9B | CTP-8 | P-17 | NO DEFECT | 1.3 |
| EXAMPLE 10B | CTP-8 | P-23 | NO DEFECT | 1.3 |
| EXAMPLE 11B | CTP-23 | P-40 | NO DEFECT | 1.7 |
| EXAMPLE 12B | CTP-13 | P-9 | NO DEFECT | 2.1 |
| EXAMPLE 13B | CTP-14 | P-14 | NO DEFECT | 1.2 |
| EXAMPLE 14B | CTP-15 | P-34 | NO DEFECT | 1.2 |
| EXAMPLE 15B | CTP-7 | P-1 | NO DEFECT | 1.3 |
| EXAMPLE 16B | CTP-7 | P-15 | NO DEFECT | 1.6 |
| EXAMPLE 17B | CTP-7 | P-17 | NO DEFECT | 1.5 |
| EXAMPLE 18B | CTP-7 | P-23 | NO DEFECT | 1.6 |
| EXAMPLE 19B | CTP-28 | P-39 | NO DEFECT | 1.3 |
| EXAMPLE 20B | CTP-32 | P-44 | NO DEFECT | 1.0 |

TABLE 27-continued

| | CHARGE TRANSPORT POLYESTER | CGM | IMAGE QUALITY AFTER 50,000 SHEETS HAVE BEEN PRINTED | AMOUNT OF ABRASION (μM) |
|---|---|---|---|---|
| EXAMPLE 21B | CTP-33 | P-1 | NO DEFECT | 0.7 |
| EXAMPLE 22B | CTP-33 | P-17 | NO DEFECT | 0.8 |
| EXAMPLE 23B | CTP-33 | P-23 | NO DEFECT | 0.8 |
| EXAMPLE 24B | CTP-45 | P-26 | NO DEFECT | 1.7 |
| EXAMPLE 25B | CTP-7 + XII | P-1 | NO DEFECT | 1.0 |
| EXAMPLE 26B | CTP-8 + XII | P-1 | NO DEFECT | 1.4 |
| COMPARATIVE EXAMPLE 1B | BENZIDINE + XI | P-1 | ABRASION FLAWS WERE FOUND OVER THE ENTIRE SURFACE AND FOG TOOK PLACE | 4.6 |
| COMPARATIVE EXAMPLE 2B | HYDRAZONE + XII | P-1 | ABRASION FLAWS WERE FOUND OVER THE ENTIRE SURFACE AND FOG TOOK PLACE | 5.8 |

CGM: charge generating material

Reference Example (Example in which the charge generating material is pigment other than one according to the present invention)

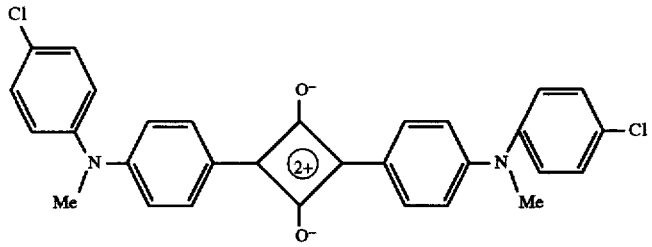

A photosensitive member was manufactured in the same manner as in Example 1 except that the charge generating layer was formed by using coating solution in which 1 part of sqallylium pigment having the foregoing structure was mixed with 1 part of polyvinylbutyrate (trade name: S-LEC BM-1) and 100 parts of butanol. Evaluation was performed, thus resulting in the photosensitivity being unsatisfactory. Since satisfactory electrostatic contrast could not be obtained, fog took place overall surface.

Evaluation

As can be understood from the results above, the electrophotographic photosensitive member according to the present invention has wear resistance and durability superior to those of the conventional photosensitive member and to those of the photosensitive member having the charge transport polymer according to the present invention and pigment other than one according to the present invention.

What is claimed is:

1. An electrophotographic photosensitive member comprising:

a photosensitive layer on a conductive substrate thereof, wherein said photosensitive layer contains a charge transport polyester resin containing at least one of structures represented by the following general formulas (I-1) and (I-2) as a partial structure of repeated units; and at least one bisazo pigment represented by the following general formula (A):

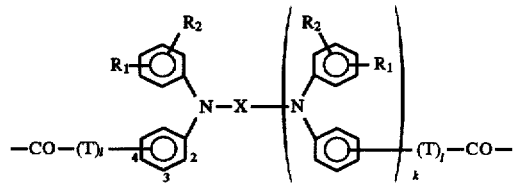

(I-1)

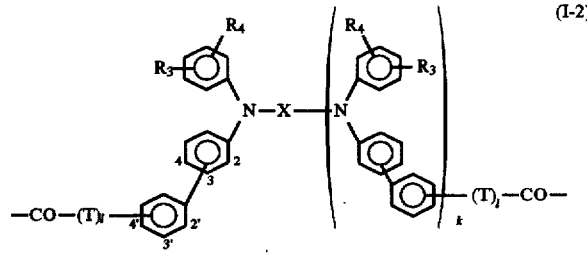

(I-2)

wherein $R_1$ to $R_4$ are each independently, a hydrogen atom, an alkyl group, an alkoxy group, a substituted amino group, halogen or a substituted or a non-substituted aryl group, X is a substituted or a non-substituted bivalent aromatic group, k and l are each an integer of 0 or 1 and T is a hydrocarbon radical having 1 to 10 carbon atoms and permitted to be branched, Cp-N=N-G-N=N-Cp' (A)

wherein Cp and Cp' are each a coupler having aromatic characteristics, Cp and Cp' may be the same or different from each other and G is a bivalent group in which each of carbon atoms, to which the azo group is bonded, is a $sp^2$-type carbon atom, which forms a double bond.

2. An electrophotographic photosensitive member according to claim 1, wherein $R_1$ to $R_4$ in general formulas (I-1) and (I-2) are each independently a hydrogen atom; an alkyl group having 1 to 4 carbon atoms; an alkoxy group having 1 to 4 carbon atoms; dimethylamino group, a diethylaminio group or a dibutylamino group; chlorine, bromine, fluorine or iodine; or an aryl group having 6 to 14 carbon atoms.

3. An electrophotographic photosensitive member according to claim 1, wherein said charge transport polyester resin is selected from the group consisting of a charge transport polyester resin represented by the following general formula (II); a charge transport polyester resin represented by the following general formula (III); and a random copolymer represented by the following general formula (IV):

$$+CO-A-CO-O-(Y-O)_{m'}\frac{}{p} \quad \text{(II)}$$

$$+CO-A-CO-O-(Y-O)_{m}-CO-Z-CO-O-(Y-O)_{m'}\frac{}{p} \quad \text{(III)}$$

$$+CO-A-CO-O-(Y-O)_{m}\frac{}{q}+CO-Z-CO-O-(Y-O)_{m'}\frac{}{r} \quad \text{(IV)}$$

wherein A is a structure represented by the foregoing general formula (I-1) or (I-2), Y and Z are each a bivalent hydrocarbon radical, m is or m's are each independently an integer from 1 to 5, p is an integer from 5 to 5,000, q is an integer from 1 to 5,000, r is an integer from 1 to 3,500 and q+r is an integer from 5 to 5,000 wherein $0.3 \leqq q/(q+r) < 1$.

4. An electrophotographic photosensitive member according to claim 3, wherein $R_1$ to $R_4$ in general formulas (I-1) and (I-2) are each independently a hydrogen atom; an alkyl group having 1 to 4 carbon atoms; an alkoxy group having 1 to 4 carbon atoms; dimethylamino group, a diethylaminio group or a dibutylamino group; chlorine, bromine, fluorine or iodine; or an aryl group having 6 to 14 carbon atoms.

5. An electrophotographic photosensitive member according to claim 1, wherein said coupler having the aromatic characteristics of said bisazo pigment represented by general formula (A) is a coupler selected from the group consisting of a coupler containing a naphthalene ring structure and a coupler containing an anthracene ring structure.

6. An electrophotographic photosensitive member according to claim 5, wherein said coupler having the aromatic characteristics of said bisazo pigment represented by general formula (A) is a coupler selected from the group consisting of a coupler containing a naphthalene ring structure to which a hydroxyl group is bonded and a coupler containing an anthracene ring structure to which a hydroxyl group is bonded.

7. An electrophotographic photosensitive member according to claim 3, wherein said coupler having the aromatic characteristic of said bisazo pigment represented by general formula (A) is a coupler selected from the group consisting of a coupler containing a naphthalene ring structure and a coupler containing an anthracene ring structure.

8. An electrophotographic photosensitive member according to claim 7, wherein said coupler having the aromatic characteristics of said bisazo pigment represented by general formula (A) is a coupler selected from the group consisting of a coupler containing a naphthalene ring structure to which a hydroxyl group is bonded and a coupler containing an anthraquinone ring structure to which a hydroxyl group is bonded.

9. An electrophotographic photosensitive member according to claim 1, wherein G of said bisazo pigment represented by general formula (A) is selected from the group consisting of the following formulas (a), (b), (c), (d), (e) and (f):

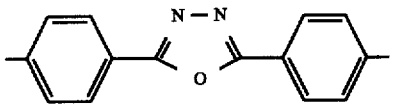

(a)

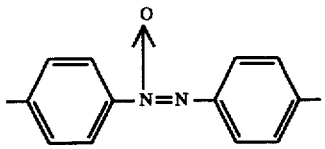

(b)

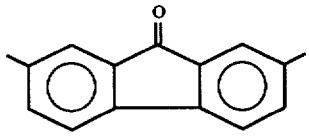

(c)

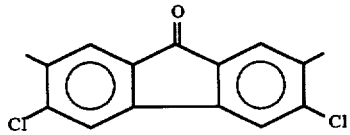

(d)

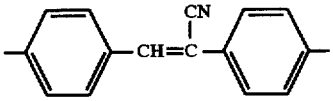

(e)

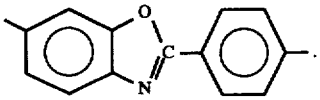

(f)

10. An electrophotographic photosensitive member according to claim 8, wherein G of said bisazo pigment represented by general formula (A) is selected from the group consisting of the following formulas (a), (b), (c), (d), (e) and (f):

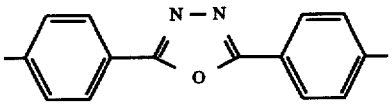

(a)

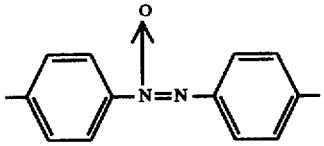

(b)

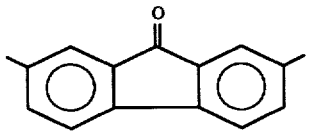

(c)

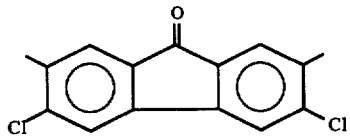

(d)

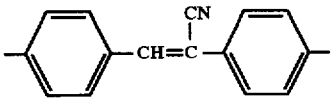

(e)

-continued

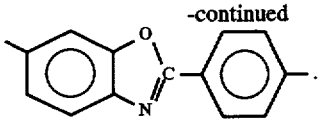

(f)

11. An electrophotographic photosensitive member comprising:

a photosensitive layer on a conductive substrate thereof, wherein said photosensitive layer contains a charge transport polyester resin containing at least one of structures represented by the following general formulas (I-1) and (I-2) as a partial structure of repeated units; and at least one condensational and polycyclic aromatic pigment:

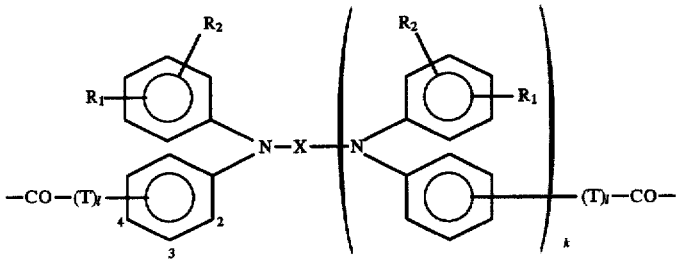

(I-1)

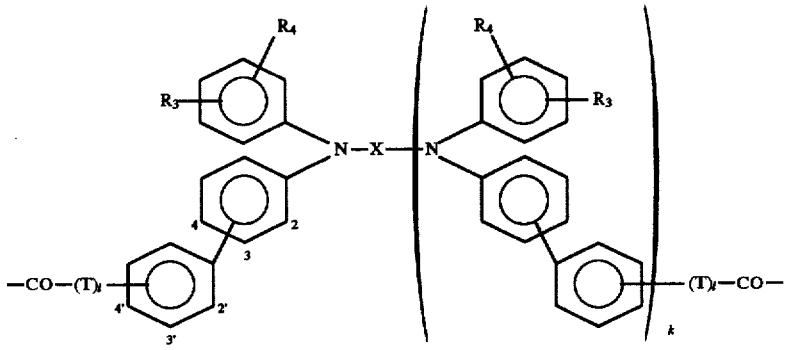

(I-2)

wherein $R_1$ to $R_4$ are each independently, a hydrogen atom, an alkyl group, an alkoxy group, a substituted amino group, halogen or a substituted or a non-substituted aryl group, X is a substituted or a non-substituted bivalent aromatic group, k and l are each an integer of 0 or 1 and T is a hydrocarbon radical having 1 to 10 carbon atoms and permitted to be branched.

12. An electrophotographic photosensitive member according to claim 11, wherein $R_1$ to $R_4$ in general formulas (I-1) and (I-2) are each independently a hydrogen atom; an alkyl group having 1 to 4 carbon atoms; an alkoxy group having 1 to 4 carbon atoms; dimethylamino group, a diethylaminio group or a dibutylamino group; chlorine, bromine, fluorine or iodine; or an aryl group having 6 to 14 carbon atoms.

13. An electrophotographic photosensitive member according to claim 11, wherein said charge transport polyester resin is selected from the group consisting of charge transport polyester resin represented by the following general formula (II); charge transport polyester resin represented by the following general formula (III); and a random copolymer represented by the following general formula (IV):

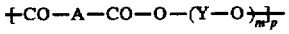

(II)

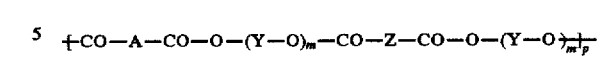

(III)

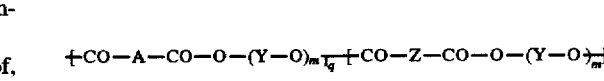

(IV)

wherein A is a structure represented by the foregoing general formula (I-1) or (I-2), Y and Z are each a bivalent hydrocarbon radical, m is or m's are each independently an integer from 1 to 5, p is an integer from 5 to 5,000, q is an integer from 1 to 5,000, r is an integer from 1 to 3,500 and q+r is an integer from 5 to 5,000 wherein $0.3 \leqq q/(q+r) < 1$.

14. An electrophotographic photosensitive member according to claim 13, wherein $R_1$ to $R_4$ in general formulas (I-1) and (I-2) are each independently a hydrogen atom; an alkyl group having 1 to 4 carbon atoms; an alkoxy group having 1 to 4 carbon atoms; dimethylamino group, a diethylaminio group or a dibutylamino group; chlorine, bromine, fluorine or iodine; or an aryl group having 6 to 14 carbon atoms.

15. An electrophotographic photosensitive member according to claim 10, wherein said condensational and polycyclic aromatic pigment is a pigment selected from the group consisting of benzanthrone, dibromobenzanthrone, benyl, dibenzanthrone, isoviolanthrone, dichloroisoviolanthrone, pyranthrone, anthoanthrone, dibromoanthoanthrone, indanthrone and dichloroindanthrone and perylene pigment.

16. An electrophotographic photosensitive member according to claim 15, wherein said perylene pigment is represented by a formula selected from the group consisting of the following general formulas (g), (h), (i) and (j):

(g)

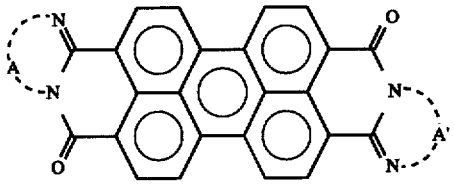

(h)

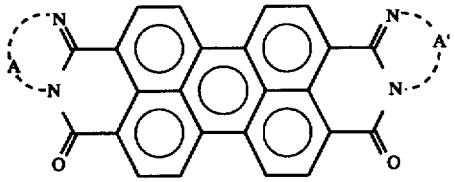

(i)

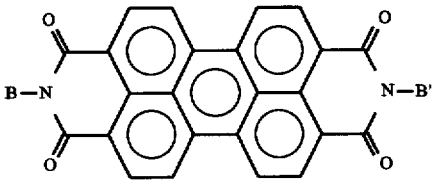

(j)

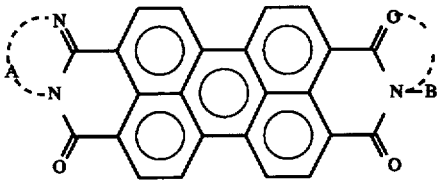

wherein A and A' are each a bivalent aromatic hydrocarbon radical or a bivalent heterocyclic group containing a nitrogen atom in the ring thereof, A and A' may be the same or different from each other, B and B' are each an alkyl group, a substituted or a non-substituted aryl group or a substituted or a non-substituted aralkyl group and B and B' may be the same or different from each other.

17. An electrophotographic photosensitive member according to claim 16, wherein A and A' in general formulas (g), (h), (i) and (j) are each selected from the group consisting of a group containing a benzene ring structure, a group containing a pyridine ring structure, a group containing a pyrazine ring structure, a pyrimidine ring structure and a group containing a naphthalene ring structure, B and B' are each an aryl group or an aralkyl group, having a benzene ring structure and B and B' may be the same or different from each other.

18. An electrophotographic photosensitive member according to claim 15, wherein said condensational and polycyclic aromatic pigment is dibromoanthoanthrone pigment represented by the following formula (k):

(k)

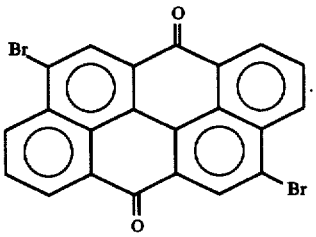

19. An electrophotographic photosensitive member according to claim 13, wherein said condensational and polycyclic aromatic pigment is pigment selected from the group consisting of benzanthrone, dibromobenzanthrone, benyl, dibenzanthrone, isoviolanthoene, dichloroisoviolanthrone, pyranthrone, anthoanthrone, dibromoanthoanthrone, indanthrone and dichloroindanthrone and perylene pigment.

20. An electrophotographic photosensitive member according to claim 19, wherein said perylene pigment is represented by a formula selected from the group consisting of the following general formulas (g), (h), (i) and (j):

(g)

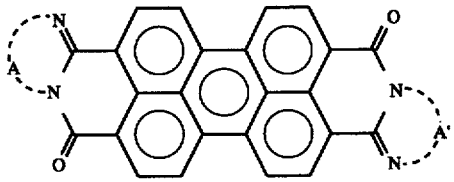

(h)

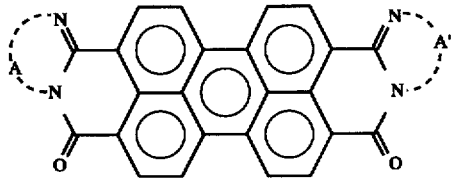

(i)

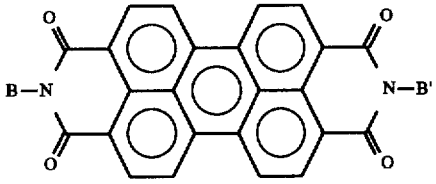

(j)

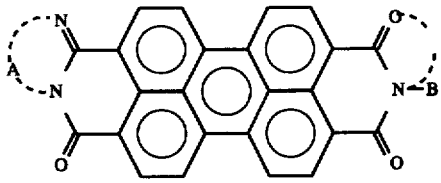

where A and A' are each a bivalent aromatic hydrocarbon radical or a bivalent heterocyclic group containing a nitrogen atom in the ring thereof, A and A' may be the same or different from each other, B and B' are each an alkyl group, a substituted or a non-substituted aryl group or a substituted or a non-substituted aralkyl group and B and B' may be the same or different from each other.

* * * * *